US005654738A

United States Patent [19]

Spurlock

[11] Patent Number: 5,654,738

[45] Date of Patent: Aug. 5, 1997

[54] FILE-BASED VIDEO DISPLAY MODE SETUP

[75] Inventor: Randolph W. Spurlock, Roundrock, Tex.

[73] Assignee: Compaq Computer Corporation, Houston, Tex.

[21] Appl. No.: 62,771

[22] Filed: May 17, 1993

[51] Int. Cl.[6] ..... G09G 5/00

[52] U.S. Cl. ..... 345/132; 345/185

[58] Field of Search ..... 345/132, 185; 358/140, 169, 168, 903; 364/521

[56] References Cited

U.S. PATENT DOCUMENTS

| | | | |
|---|---|---|---|
| 4,439,762 | 3/1984 | Van Vliet et al. | 345/132 |
| 4,905,167 | 2/1990 | Yamaoka et al. | 364/521 |
| 4,918,436 | 4/1990 | Johary | 345/132 |
| 4,926,166 | 5/1990 | Fujisawa et al. | 345/132 |
| 4,991,023 | 2/1991 | Nicols | 358/168 |
| 5,065,346 | 11/1991 | Kawai et al. | 345/132 |
| 5,086,295 | 2/1992 | Boettacher et al. | 345/132 |
| 5,150,109 | 9/1992 | Berry | 345/132 |
| 5,189,401 | 2/1993 | Kugler, Jr. et al. | 340/132 |
| 5,379,052 | 1/1995 | Walck et al. | 345/132 |
| 5,402,148 | 3/1995 | Post et al. | 345/132 |

FOREIGN PATENT DOCUMENTS

| | | | |
|---|---|---|---|
| 0303138 | 2/1989 | European Pat. Off. | 345/132 |

OTHER PUBLICATIONS

"Upgrading and Repairing PCs" Scott Mueller 1988, pp. 442–443.

*Primary Examiner*—Richard Hjerpe
*Assistant Examiner*—Amare Mengistu
*Attorney, Agent, or Firm*—Vinson & Elkins L L.P.

[57] ABSTRACT

A computer system and method of operating the same to setup a graphics display driver and device are disclosed. The disk storage of the computer system contains a monitor file that specifies various video modes operable by a number of monitor types and models, and also contains a mode file that specifies the video modes operable by a number of graphics controllers. The mode file also contains the video parameters for each of the available video modes. During a setup routine, the computer system determines the monitor and graphics controller that are installed, and for each available driver program, selects a video mode compatible with each; if more than one video mode is compatible, the computer system may select the best video mode. Upon selection of the video mode, and upon installation of the driver, the computer system reads the video parameters from the mode file for the selected mode, such video parameters stored in an interpretive language, and executes the program in order to program the graphics controller according to the video parameters. This arrangement eliminates the need to maintain the video parameters in the driver executable, and thus facilitates configuration and maintenance of the computer system.

16 Claims, 4 Drawing Sheets

FIG. 3
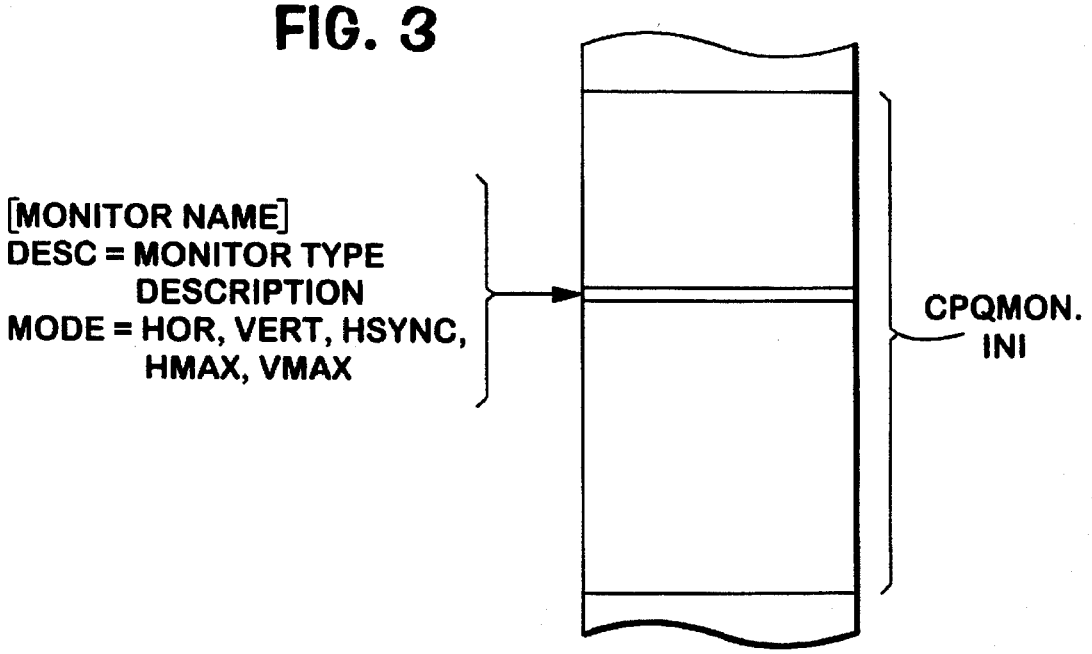
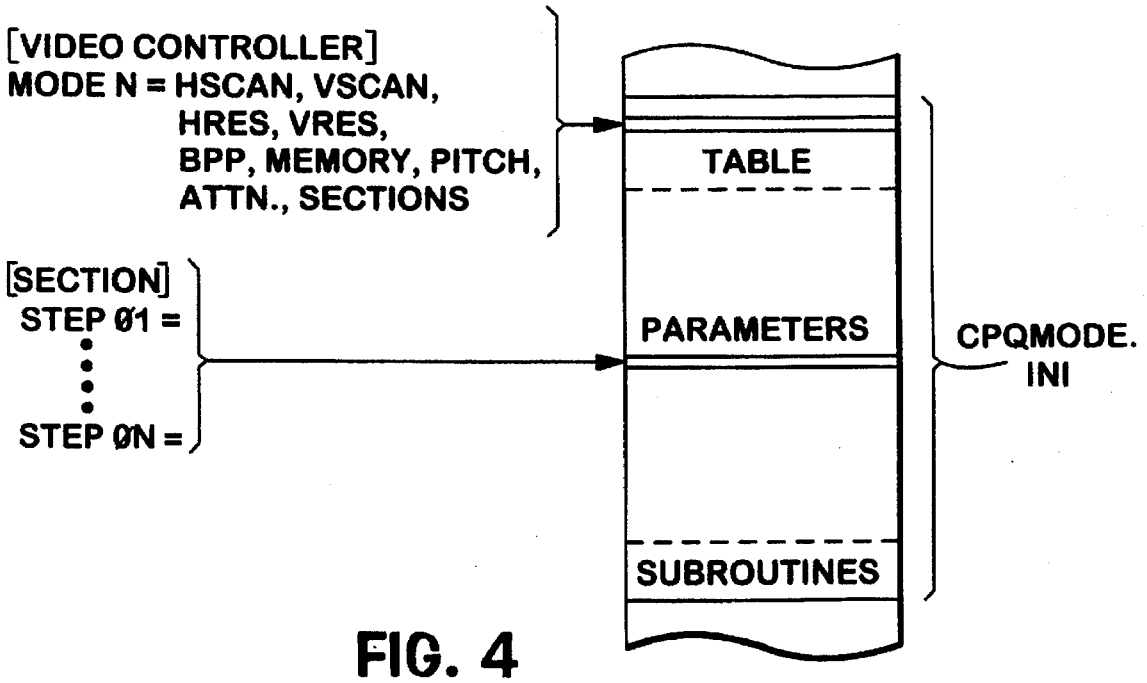
FIG. 4

FILE-BASED VIDEO DISPLAY MODE SETUP

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

This invention is in the field of data processing, and is more specifically directed to the interfacing of a video display device to a computer.

BACKGROUND OF THE INVENTION

In the modern personal computer industry, the consumer is able to select system components from a wide range of performance specifications, price, and vendors. As such, those personal computers that utilize a common microprocessor architecture are currently configurable, by way of the operating system, to accept components from a wide range of sources and that have a wide range of capabilities.

A particularly important system component, and one which is available in a wide range of performance ranges and prices, is the video display monitor. According to the widely known so-called "IBM-compatible" personal computer architecture, an expansion slot in the personal computer receives a hardware graphics controller which in turn is connected to the monitor. The graphics controller receives information from the computer central processing unit (CPU) and presents the information to the monitor in a format suitable for the monitor to display the information.

However, not only must the graphics controller hardware be capable of receiving the display information and presenting the same to the monitor, but the computer software must also be capable of controlling such an interface. For computers using the well-known MS-DOS operating system in combination with the WINDOWS windowing operating environment, both available from Microsoft Corporation, certain computer programs commonly referred to as "drivers" provide such an interface. As is well known in the art, a driver contains program code that can be called by the operating system and used to provide data to the graphics controller in a format suitable for the controller to receive and process the data for display on the monitor.

As is well known in the art, many types of graphics controllers are available; particular standards, such as VGA, AVGA, and IVGS have evolved according to which such controllers operate. In addition, new graphics controllers, such as the QVISION graphics controller available from Compaq Computer Corporation, are now available that are capable of performing enhanced and complex graphics operations on data provided to it by the CPU, resulting in improved resolution images displayed on the monitor. Many of these controllers include the capability of operating according to several video modes, where a video mode refers to a set of parameters including display resolution, color depth, scan rate and the like. As such, the operating system for the personal computer generally includes a number of different driver programs so that the appropriate driver may be selected to operate with the particular graphics controller and monitor selected by the consumer. Conventional drivers include video mode information necessary to operate the monitor in its executable code.

Heretofore, a particularly troublesome problem for personal computers operating according to the WINDOWS environment has been the configuration of the system relative to the large universe of controllers, monitors and video modes. For proper operation, the appropriate driver must be installed and enabled for the particular monitor and graphics controller inserted in the system, and the appropriate video mode for the installed driver must be selected. In the WINDOWS environment, the WINDOWS SETUP utility program available from Microsoft Corporation is generally executed to accomplish this configuration. However, in this conventional arrangement, the video mode information is contained within the driver executable code, and is thus invisible to the SETUP utility. Accordingly, the conventional SETUP utility itself includes information indicating the video modes available for the particular driver.

While this conventional arrangement of the video mode information in the driver executable code, in combination with mode availability information available in the SETUP utility, operates well once the system is configured, the maintenance and upgrading of the driver or display hardware is extremely cumbersome. For example, because the video mode information is embedded in the driver executable, the driver must be fully reinstalled each time that it is upgraded with a new video mode; in addition, because the SETUP utility also contains mode information, it must also be upgraded (i.e., reinstalled) each time that a driver receives a new video mode.

In addition, circumstances often arise where a slight tuning of the video mode information can correct a display problem. For example, if a computer customer purchases a large number of monitors from a source other than the computer (and graphics controller) manufacturer, and if the monitors are slightly off-spec to the extent that display anomalies are present, it may often be possible to merely modify one of the parameters in the video mode information to correct the problem. However, under the conventional driver and SETUP utility arrangement, modification of the video mode information requires modification and reinstallation of the entire driver, and may also require upgrading of the SETUP utility to reflect a new video mode. Considering that modern graphics controllers, such as the QVISION controller available from Compaq Computer Corporation, are capable of operating according to as many as one hundred video modes, the upgrading of video modes according to the conventional arrangement is extremely cumbersome.

It is therefore an object of the present invention to provide a method of storing video mode information in such a manner that it may be updated and upgraded to provide a new video mode for an existing driver without requiring reloading of the driver itself and of a setup utility.

It is a further object of the present invention to provide such a method that can also program the controller according to the desired video mode.

It is a further object of the present invention to provide such a method that can be readily adjusted by the computer user.

It is a further object of the present invention to provide such a method that can assist the computer user in selection of the best video mode for the existing system configuration.

Other objects and advantages of the present invention will be apparent to those of ordinary skill in the art having reference to the following specification together with its drawings.

SUMMARY OF THE INVENTION

The invention may be incorporated into a personal computer by providing a mode file in which video mode information is stored separately from the driver executable code. This mode file contains the video mode information for a number of video modes for a number of graphics controllers. Upon selection of the video mode for the particular graphics controller, a buffer is loaded with the contents of the video mode file in a manner that may be executed to program the graphics controller with the video mode information. The storage of the video mode information in a mode file separate from the driver allows for the video mode information to be edited and upgraded without requiring a new release of the driver or of a setup utility.

According to another aspect of the invention, a monitor file is provided which stores information for a number of monitor types regarding the video modes in which they can operate. The setup utility can interrogate the monitor to determine its model, or alternatively ask the human user to input the model; upon determining the monitor model and the controller used, the setup utility can select, or assist in the selection of, the best video mode for the installed monitor.

BRIEF DESCRIPTION OF THE DRAWINGS

FIG. 3 is a diagram illustrating the construction of a monitor information file according to the preferred embodiment of the invention.

FIG. 4 is a diagram illustrating the construction of a mode information file according to the preferred embodiment of the invention.

DETAILED DESCRIPTION OF THE PREFERRED EMBODIMENT

Figure 1:
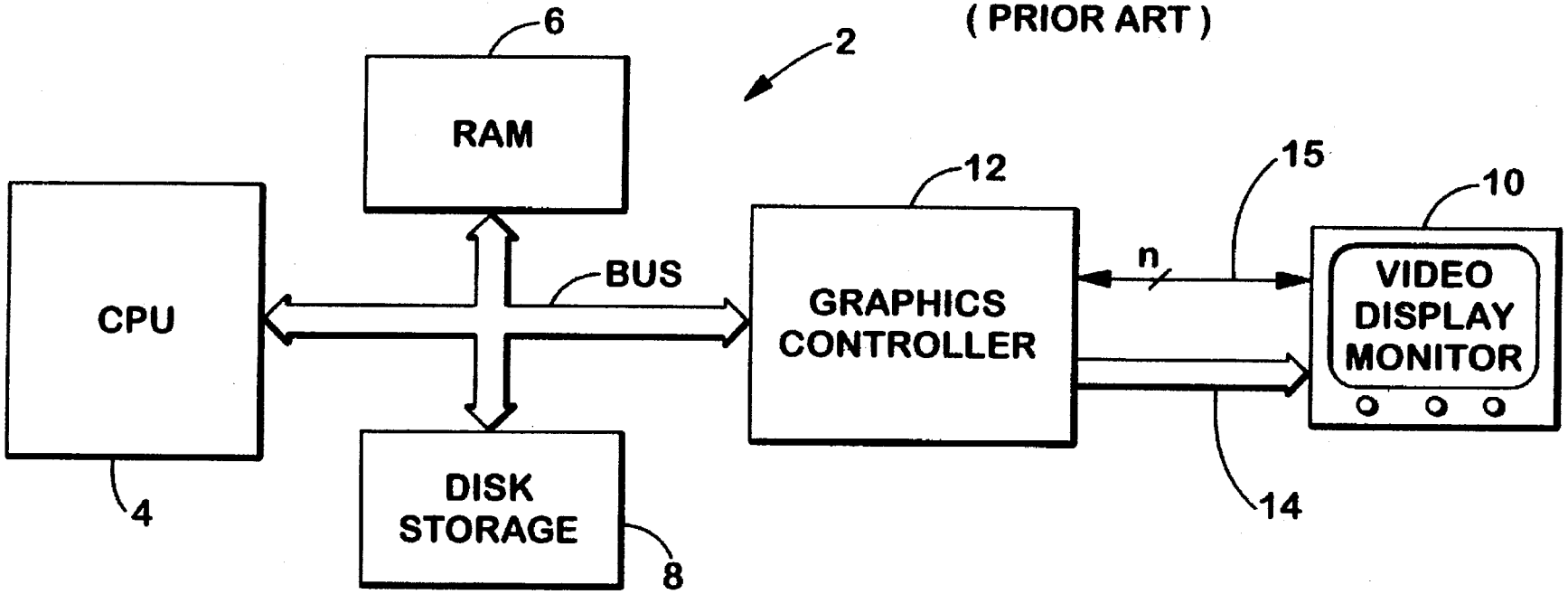
FIG. 1 (PRIOR ART)
FIG. 1 is an electrical diagram, in block form, of a computer system with which the present invention is useful.

Referring now to FIG. 1, computer system 2 constructed in the conventional manner, and within which the present invention is implemented according to the preferred embodiment of the present invention, will be described generally. Computer system 2 includes a central processing unit (CPU) 4. As is well known in the art, CPU 4 is conventionally implemented as a microprocessor, may contain some amount of on-chip random access memory (RAM), and is capable of performing most of the data processing operations required of computer system 2. CPU 4 is connected to bus BUS for communication with other devices in computer system 2; bus BUS includes data lines, address lines, and control lines, as is conventional in the art. CPU 4 can store and retrieve information temporarily in external RAM 6 by way of bus BUS; non-volatile mass storage of information in disk 8 is similarly effected by CPU 4 via bus BUS.

Video display monitor 10 is implemented into system 2 to provide visual display of text and graphics information processed by CPU 4. As is conventional in the art, graphics controller 12 is coupled to bus BUS to receive information from CPU 4 (and to provide information thereto, as the case may be). Graphics controller 12 processes the information received on bus BUS and presents it to monitor 10 by way of communication lines 14; for example, communication lines 14 may be three analog lines corresponding to the red, green and blue color components to be displayed (i.e., RGB). In this case, graphics controller 12 would include digital-to-analog conversion circuitry to convert the digital information processed by CPU 4 into analog form for presentation to monitor 10. In addition, bidirectional control bus 15 is also provided between graphics controller 12 and monitor 10, by way of which control signals are communicated therebetween. An example of such control signals include monitor sense ID lines, by way of which monitor 10 indicates its type and model to graphics controller 12.

Other conventional components present in graphics controller 12 may include video RAM, and also a programmable graphics processor. An example of a conventional graphics controller is the QVISION controller available from Compaq Computer Corporation, Houston, Tex.

Of course, other storage, input and output devices may also be implemented into computer system 2; the few devices illustrated in FIG. 1 are provided by way of example only. In addition, devices such as disk 8 may be coupled to bus BUS by way of a disk controller or other circuitry in the conventional manner; such controllers are not shown in the general diagram of FIG. 1.

As is well known in the art, particularly for computers that utilize the MS-DOS operating system in combination with the WINDOWS windowing operating environment, computer system 2 will have a number of programs stored in disk 8 (or in RAM 6, if actively operating) that provide an interface between CPU 4 and devices such as monitor 10. Such programs are referred to in the art as drivers, and are generally present for output devices such as monitors and printers. In the WINDOWS environment, these drivers are accessed by the API (applications program interface) program which is part of the WINDOWS manager program. The graphics driver remains resident in the system memory during the operation of computer system 2, and is activated by CPU 4 making a "call" to one of its functions; upon receiving the call, the driver will execute certain operations, including the receipt of data from CPU 4 via bus BUS, and will process it into a form suitable for display on monitor 10.

As noted above, many different types of monitors 10 and graphics controllers 12 are readily available, each of which is designed to receive information from CPU 4 and visually display the same. In addition, the video information may be displayable in many different "modes". Video modes are generally defined by the number of bits available for each picture element (pixel), the number of pixels displayable across one line of the monitor, the number of lines displayable on the monitor, and the like. It is generally the function of the graphics controller 12, together with the appropriate driver program, to receive the information from CPU 4 on bus BUS and to process it into the proper form for display in the selected video mode.

Figure 2:
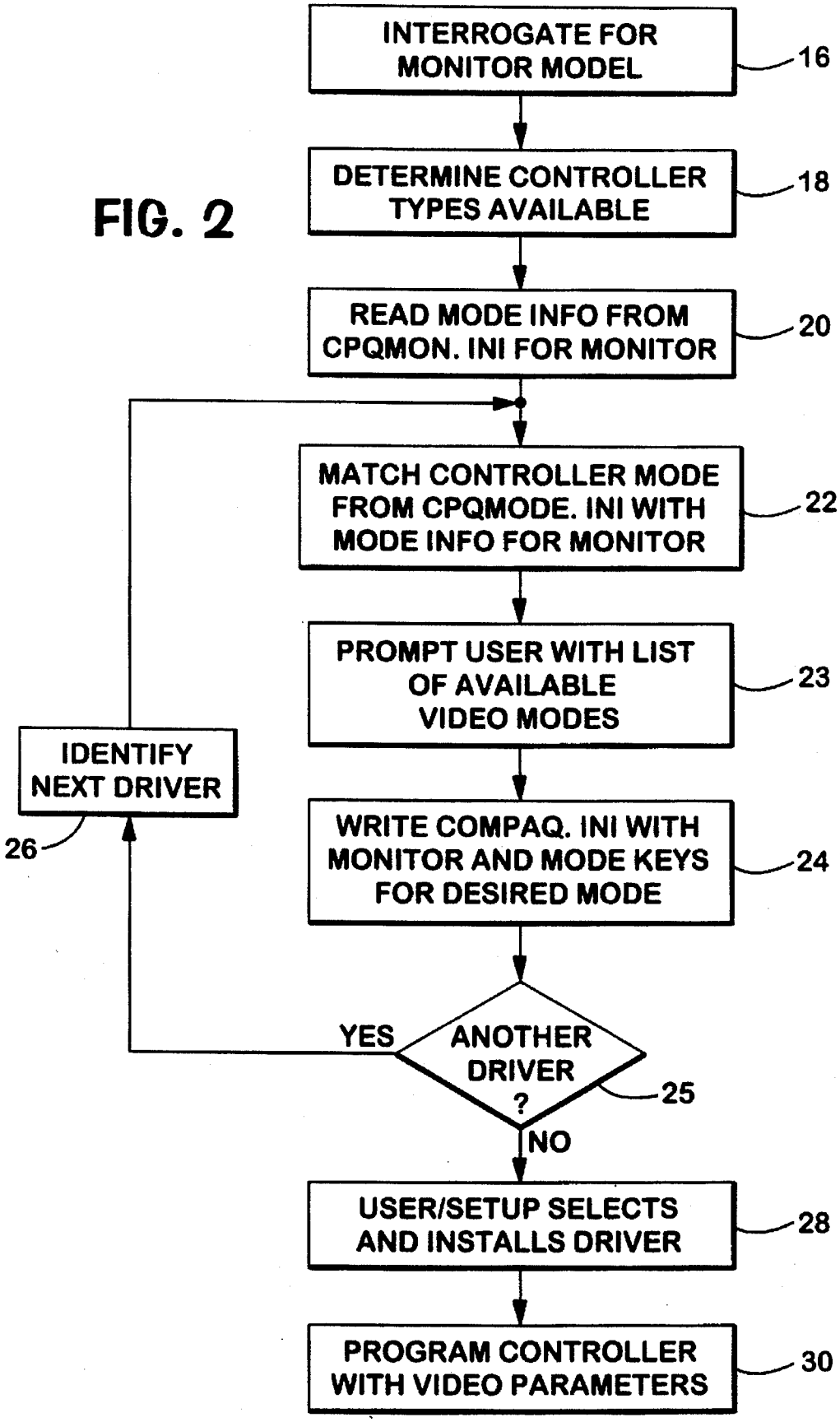
FIG. 2 is a flow chart illustrating a method of operating a computer according to the preferred embodiment of the invention.

Referring now to FIG. 2, a setup method according to the preferred embodiment of the invention will now be shown, this setup method being capable of allowing great flexibility in the designation of a monitor type and video mode, depending upon the graphics controller 12 present in the system and upon the driver software installed therein. The setup method illustrated in FIG. 2 may be performed by a setup utility program that is stored in disk storage 8 of computer system 2 of FIG. 1, and that is executed by CPU 4 upon startup of system 2 or responsive to a specific command by the user.

The setup program according to this embodiment of the invention begins with process 16, in which the type and model of monitor 10 in system 2 is determined. Process 16 may be performed by system 2 without intervention by the user for those monitors 10 that include a sense ID code and that can communicate the same via control bus 15 to graphics controller 12. Examples of such monitors include the QVISION models 150, 170, and 200 monitors available from Compaq Computer Corporation. If monitor 10 is not of a type having such sense ID capability, process 16 prompts the human user of system 2 to interactively select or enter the model and type of monitor 10. Process 18 is then performed, by way of which the type and identification of graphics controller 12 is determined by CPU 4. In most modern computer systems 2, each graphic controller 12 suitable for use according to conventional standards includes an identification code interrogatable by CPU 4; such identification code may be located, for example, in a read-only-memory (ROM) as part of graphics controller 12 or may otherwise be built into graphics controller 12 itself.

Upon determining the type and model of monitor 10 and graphics controller 12, the setup utility of the preferred embodiment of the invention next determines the video mode suitable for use with this combination. This operation begins with process 20, in which CPU 4 reads video mode information from monitor information file CPQMON.INI stored in disk storage 8. File CPQMON.INI is preferably in an ASCII format so as to be human-readable and readily editable. FIG. 3 illustrates the construction and contents of file CPQMON.INI according to the preferred embodiment of the invention. Appendix A is a listing of an example of file CPQMON.INI for an actual computer system 2 according to the preferred embodiment of the invention.

According to this embodiment of the invention, file CPQMON.INI is in the standard ".INI" format of the WINDOWS windowing operating environment. As such, each entry in file CPQMON.INI includes a section heading in brackets; in this example, the section heading identifies the monitor by a particular code name, for example [CPQ-QVision_200]. Following the section heading monitor identifier, file CPQMON.INI provides, for each monitor identified, a monitor type description key "Desc=", followed by the monitor type description value. An example of the monitor type description key and value, for the [CPA-Qvision_200] monitor, is as follows:

Desc=COMPAQ QVision 200 Color Monitor

The monitor type description value thus provides a description of the monitor type identified by the section. For those monitors having an identifier that may be sensed by the monitor sense lines, the next key in file CPQMON.INI is the monitor ID key MonID, followed by the value the monitor ID code. For the example of the COMPAQ QVision 200 Color Monitor, this key and value are as follows:

MonID=4 meaning that the value returned on the sense ID lines of control bus 15 in process 16 is 4.

Each of the monitor types in file CPQMON.INI next specifies information regarding the video mode or modes in which the monitor will function. This information includes parameters regarding the scan rate, pixel counts, and synchronization polarity convention. In addition, as is well known, some monitors can operate in more than one mode; as such, file CPQMON.INI will have multiple mode information keys and values in those sections corresponding to such multiple mode monitors. In this example, the arrangement of the Mode keys in file CPQMON.INI is as follows:

Mode=Horizontal, Vertical, Hsync, Vsync, Hmax, Vmax where Horizontal specifies the horizontal scan rate in kHz, where Vertical specifies the vertical scan rate in Hz, where Hsync and Vsync specify the horizontal and vertical sync signal polarity, respectively, where Hmax specifies the maximum horizontal pixel count, and where Vmax specifies the maximum vertical scan line count. Each of the horizontal and vertical scan rate values may be specified as either a fixed value or a range of frequencies, depending upon the monitor. An example of the Mode key in file CPQMON.INI for the COMPAQ QVision 200 Color Monitor, such a monitor capable of operating over a range of scan frequencies, is as follows:

Model=31.5–82.0, 50.0–90.0, +, +, 1280, 1024

Model for this monitor is thus a 1280 by 1024 display, and can operate over a wide range of scan frequencies. Attention is directed to Appendix A hereof for additional examples of the video modes available for various monitors.

Referring back to FIG. 2, the setup utility next matches, for the first (or only, as the case may be) driver program in its disk storage 8, controller video mode information from another file referred to as CPQMODE.INI, on one hand, with that mode information for the installed monitor 10 determined from file CPQMON.INI as discussed above, on the other hand. Referring now to FIG. 4, the construction and contents of file CPQMODE.INI will now be described in detail.

File CPQMODE.INI is preferably also an ASCII file in the Microsoft ".INI" format for ease of reading and editing, and contains three portions according to the preferred embodiment of the invention. Each of these portions refer to the video mode capabilities of graphics controllers that may be used in system 2. The top portion, illustrated as TABLE in FIG. 4, contains information regarding the video modes available for each graphics controller in a similar fashion as the video mode information contained in file CPQMON.INI for the monitors. The second portion of file CPQMODE.INI, illustrated as PARAMETERS in FIG. 4, contains video parameters that are used to program the particular graphics controller 12 once the video mode is selected, as will be described in further detail hereinbelow. These video parameters correspond to those parameters well-known in the art for establishing the analog signals provided to monitor 10 to effect the video display, including frequencies of operation, and blanking and synchronization signals; these video parameters were formerly included in the executable code of the driver, as noted above. The third portion of file CPQMODE.INI, illustrated as SUBROUTINES in FIG. 4, includes certain subroutines that may be called by the PARAMETERS portion of file CPQMODE.INI and will also be described in detail hereinbelow. An example of a file CPQMODE.INI from an actual computer system 2 according to the preferred embodiment of the invention is attached hereto as Appendix B.

Process 22 of the setup utility of FIG. 2 utilizes the TABLE portion of file CPQMODE.INI to match the available video modes of graphics controller 12 to monitor 10 for the currently evaluated driver. The TABLE portion of file CPQMODE.INI includes a section for each graphics controller, identified in a bracketed section heading. For example, the QVISION controller has a section in the TABLE portion of file CPQMODE.INI headed by [QVISION]. A key and value for each video mode operable for the graphics controller then follows the section heading. Each key and value, for each video mode, is arranged as follows:

ModeID=HScan, VScan, HRes, VRes, BPP, Memory, Pitch, Attributes, Section(s)

In the example of file CPQMODE.INI, HScan and VScan correspond to the horizontal and vertical scan rates in kHz and Hz, respectively, and HRes and VRes correspond to the horizontal and vertical resolution in pixels, respectively. The BPP value indicates the bits per pixel for the video mode, Memory indicates the required video RAM size in Kbytes, and Pitch indicates the display pitch (memory distance between adjacent rows in the displayed image) in bytes. The Attributes value is a programmed word indicating the level of capability for different components within graphics controller 12 for operating that video mode, such components including controller type, digital-to-analog (DAC) type, and phase-locked loop type. The Sections value indicates the section or sections in the PARAMETERS portion of file CPQMODE.INI that contain the actual video parameters for that video mode with which graphics controller 12 is to be programmed; more than one section may be indicated for a video mode, if special programming for graphics controller 12 is necessary to operate the mode.

An example of the TABLE portion section for the QVISION graphics controller, in one of the possible 1280 by 1024, four bits-per-pixel, modes is as follows:

Mode_1280×1024×4_1a=80.5, 76.0, 1280, 1024, 4, 1024, 1024, 25096, QV04_1280_1024_1, QV-Setup_2048

Attention is directed to Appendix B for additional examples of video modes for various controllers. It should be noted that certain controllers may only operate in a single mode (e.g., the IVGS controller), while others have many modes available. Indeed, the QVISION controller may operate in up to one hundred video modes.

Process 22 (FIG. 2) thus, with knowledge of the driver and graphics controller 12, matches the appropriate controller video mode from file CPQMODE.INI with the video mode specified for monitor 10 in file CPQMON.INI. Given that some graphics controllers 12 have multiple video modes available, and that some monitors 10 may operate according to multiple video modes, process 22 may determine that, for a particular driver, multiple modes may be operable for the particular installed combination of controller 12 and monitor 10. Process 22 will then select the "best" mode for use with that combination according to a predetermined hierarchy (e.g., the video mode with the highest refresh rate is selected). If several video modes are available, for example if several pixel depths may be available, these multiple choices will be presented to the human user in process 23, responsive to which the human user selects one of the displayed video modes.

Upon selection of the desired video mode in process 22, process 24 is then performed by way of which file COMPAQ.INI is written by CPU 4 with the selected monitor and mode information. File COMPAQ.INI, which is preferably also an ASCII file in the Microsoft ".INI" format for ease of reading and editing, is thus also organized according to sections, each section referring to a particular driver program in system 2. An example of file COMPAQ.INI for an actual computer system 2 according to the preferred embodiment of the invention, where monitor 10 is a Compaq QVISION 200 Color Monitor and where graphics controller 12 is a Compaq QVISION graphics controller, is provided herewith in Appendix C.

File COMPAQ.INI according to this embodiment of the invention has a driver identifier in its bracketed section heading; for example, one driver in file COMPAQ.INI of Appendix C is identified by the section [cpq1qv04]. The section for each driver is first written, in process 24, with a Controller key having a value identifying the controller and mode that was selected for that driver in process 22, corresponding to the controller section and mode key in file CPQMODE.INI. The next key written to file COMPAQ.INI is the Monitor key, which specifies the monitor section and mode key from file CPQMON.INI selected in process 22. Other keys may be written to file COMPAQ.INI, including the size of driver resources (e.g., icons and cursors), and also selection of whether the contents of file COMPAQ.INI are to be displayed upon driver installation (Print=True or False).

Referring back to FIG. 2, decision 25 is then performed, by way of which the setup utility determines if another driver program is available for installation, in which case processes 22, 23, 24 are repeated to write another section in file COMPAQ.INI for that particular driver. In this way, multiple drivers resident in disk storage 8 will have their particular video modes preselected based upon the monitor 10 in system 2, prior to driver installation.

If no additional drivers are to be setup in file COMPAQ.INI (i.e., decision 25 is negative), process 28 is performed to select the driver to be installed. Process 28 may be performed automatically by way of the setup utility, or alternatively the human user may expressly select a driver for installation in the setup utility. Upon selection of the desired driver, process 30 is initiated by way of which the driver is installed and graphics controller 12 programmed to operate in the video mode selected for that driver in process 22.

Figure 5:
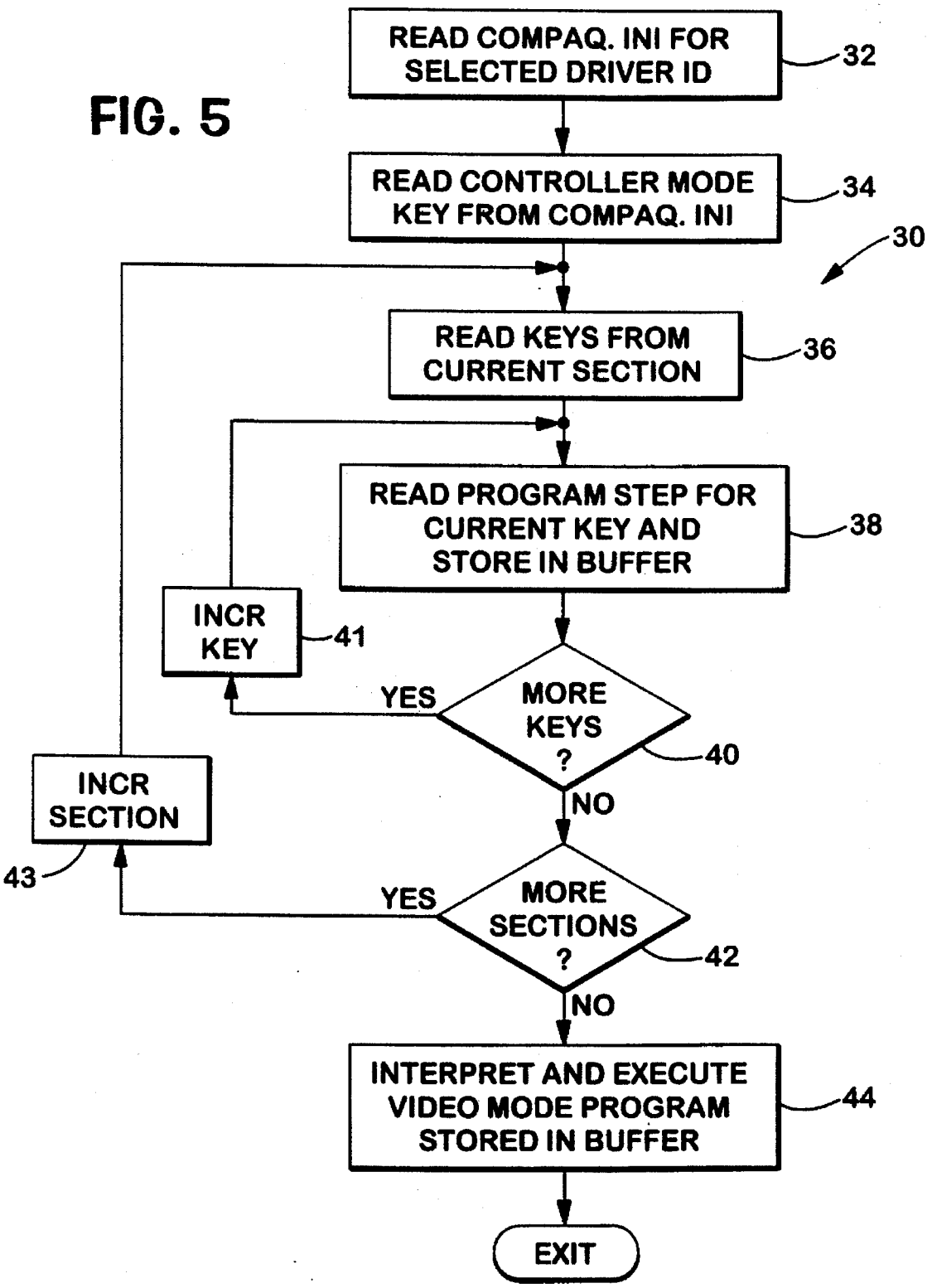
FIG. 5 is a flow chart illustrating a portion of the method shown in FIG. 2 in which a graphics controller is programmed according to the preferred embodiment of the invention.

Process 30 will now be described in further detail relative to FIG. 5; as above, process 30 is performed by CPU 4 as part of the operating system. Process 32 is first performed, by way of which the selected driver identification is used to read the appropriate section of file COMPAQ.INI. This read returns, in process 34, the value for the controller mode key, in particular the Sections value at the end of the values for the controller mode key. Referring to FIG. 4, the returned Sections value transfers control to the PARAMETERS portion of file CPQMODE.INI having the section header corresponding to the contents of the Section value in the TABLE portion of file CPQMODE.INI for that video mode. The PARAMETERS portion of file CPQMODE.INI includes a number of keys indicated as "StepXX" where XX indicates the sequence of the step in the section. Each Step corresponds to a program instruction for programming graphics controller 12, and is loaded into a buffer area of RAM 6 in processes 36 through 42 of FIG. 5.

According to this embodiment of the invention, the program instructions contained in the PARAMETERS portion of file CPQMODE.INI and that are stored in the buffer area in processes 36 through 42 are in an interpretive language. The contents of the buffer area are then executed in process 44 as an interpretive video mode program, programming graphics controller 12 to operate in the desired video mode.

The following is an example of section QV04_1280_1024_1, corresponding to video mode Mode_1280×1024×4_1a:

```
Step01    = Table, Seq_Packed
Step02    = Table, QV_Setup_4
Step03    = OB, 3C2h, 27h
Step04    = Table, Qv_dac_4
Step05a   = OB 3D4h.00h, CAh, 9Fh, 9Fh, 8Dh, A9h †
Step05b   =              IDh, 24h, 5Ah, 00h, 60h †
```

-continued

| | | | | | | | |
|---|---|---|---|---|---|---|---|
| Step05c | = | 00h, | 00h, | 00h, | 00h, | 00h | † |
| Step05d | = | 00h, | 01h, | B5h, | FFh, | 80h | † |
| Step05e | = | 00h, | FFh, | 24h, | E3h, | FFh | |
| Step06 | = OB, 3CHh.42h, 00h | | | | | | |
| Step07 | = OB, 3CEh.51h, E8h | | | | | | |
| Step08 | = Table, QV_Cursor | | | | | | |
| Step09 | = Table, Attr_Ctrl_8 | | | | | | |
| Step10 | = Table, Graphics_Ctrl | | | | | | |
| Step11 | = Table, QV_DAC_Extended | | | | | | |
| Step12 | = Table, QV_DAC_External | | | | | | |

The \ character indicates that the following step or substep is a continuation. In this example, the argument "Table" refers to a subroutine in the SUBROUTINE portion of file CPQMODE.INI (see FIG. 4), which is then in turn loaded into the buffer area of RAM 6 by processes 36 through 42. The argument "OB" refers to an output byte, with the values following OB indicating data to be sent to graphics controller 12 during the execution of process 44. These data include the actual video parameters used to program controller 12 with the necessary information to convert the digital data presented thereto into the proper form to be communicated to monitor 10, for example by way of an analog signal. The specific video parameters are well known in the art, and include such parameters as necessary to provide the video output at the proper frequency, with the proper blanking and synchronization signals at the appropriate time in the analog signal, and as necessary to format the displayed information in such a manner as to control the hardware in monitor 10.

The loading of these section(s) of the PARAMETERS portion of file CPQMODE.INI begins with process 36 in which the keys from the first section are read. Process 38 then reads the program steps for the first key in the section, and stores the program steps in the buffer area of RAM 6. Decision 40 determines if additional keys in the current section are yet to be read; if so, process 41 increments to the next key in the section and returns control to process 38 for that next key. Upon completion of the keys for the first section (decision 40 returns a negative), decision 42 determines if additional sections for the desired video mode are to be loaded into the buffer area of RAM 6. If so, process 43 increments to the next section and control is returned to process 36 where the keys for that section are stored in the buffer area of RAM 6.

If no additional sections remain (i.e., decision 42 returns negative), the video mode program is fully stored in the buffer area of RAM 6. Process 44 is then performed by CPU 4, in which the video mode program stored in the buffer area of RAM 6 is executed, preferably in an interpretive fashion. In this way, the video mode parameters, originally stored in the ASCII file CPQMODE.INI according to the preferred embodiment of the invention, program graphics controller 12 to operate in the desired video mode.

Upon completion of process 44, process 30 of FIG. 2 is complete, and graphics controller 12 is programmed and ready to accept digital data on bus BUS for display on monitor 10.

The present invention provides significant advantages in the setup and operation of a computer system. A first advantage is from a maintenance standpoint, as the video mode parameters are no longer embedded within the driver executable code, but instead are resident in an ASCII file according to a well-known operating system format. As a result, the video mode parameters may be modified, and new video modes added, without requiring an additional release of the driver software, and without requiring upgrading and another release of the setup utility to comprehend the new video mode available for that driver. Accordingly, many user video problems are readily correctable by customer support staff, indeed over the telephone. In addition, editing of the video mode parameters is facilitated by the use of the ASCII file format, such that any standard editor may be used to modify or add to its contents. This allows the tuning of the video parameters so that a non-standard monitor may be used with a graphics controller, at its optimal performance level.

In addition, the present invention also provides the advantages that a human user can have the best video mode selected for the monitor that is installed, without requiring a high level of expertise and knowledge on the part of the user. The human user thus no longer has to guess at what video modes will run on the installed monitor, but need only run the Setup utility (as shown in FIG. 2) to automatically select the best video mode available.

Furthermore, it is contemplated that the interpretive language for programming graphics controller 12 according to this embodiment of the invention can be made sufficiently simple so that any developer can readily define a program for the controller.

While the invention has been described herein relative to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

APPENDIX A

Copyright 1993 Compaq Computer Corporation

1

```
;
;                    COMPAQ Monitor Configuration File
;
;       This is the monitor configuration file for the flat model Windows
;       drivers. This file contains monitor information for 3rd party
;       monitors so that they can be used with the COMPAQ video display
;       adapters. This file is in the MicroSoft standard .ini file format
;       so that it can be read/written via the Windows API. The format is
;       as follows:
;
;       [Monitor Type]
;
;       Desc = Monitor Type Description
;       Mode = Horizontal, Vertical, Hsync, Vsync, Hmax, Vmax
;
;       Where:
;
;               Horizontal      = [Fixed scan rate | Scan rate range] KHz
;               Vertical        = [Fixed scan rate | Scan rate range]  Hz
;               Hsync           = Horizontal sync signal polarity [+/-]
;               Vsync           = Vertical sync signal polarity   [+/-]
;               Hmax            = Maximum horizontal pixel count
;               Vmax            = Maximum vertical scanline count
;
;       The sync values are not required and will default to both positive
;       if not given. The maximum values are not required either and if not
;       given then any pixel/scanline value be used.
;
;       Define the CPQMon.INI File Version
;
[Version]
Version=1.0

[CPQ-VGA]
Desc = COMPAQ VGA Color Monitor, or Compatible
MonId =  14

Mode1 =  31.5,        50.0-70.0, -, -,  640,  480

[CPQ-IVGA]
Desc = COMPAQ Internal VGA Panel
MonId =  42

Mode1 =  31.5,        50.0-70.0, -, -,  640,  480

[CPQ-AGS]
Desc = COMPAQ Advanced Graphics Color Monitor
MonId =  2

Mode1 =  31.5,        50.0-75.0, -, -,  640,  480
Mode2 =  54.0,        50.0-75.0, +, +, 1024,  768

[CPQ-SVGA]
Desc = COMPAQ SVGA Color Monitor
MonId = 5

Mode1 = 31.5-38.0,    60.0-72.0, -, -,  640,  480
Mode2 = 35.2-38.0,    56.0-60.0, +, +,  800,  600

[CPQ-QVision]
```

2

```
Desc = COMPAQ QVision 150/170 Color Monitor
MonId =  6

Mode1 =  31.5-57.0,  50.0-90.0, +, +, 1024,  768

[CPQ-1024]
Desc = COMPAQ 1024 Color Monitor
MonId =  3

Mode1 =  31.5-57.0,  50.0-90.0, +, +, 1024,  768

[CPQ-QVision_200]
Desc = COMPAQ QVision 200 Color Monitor
MonId =  4

Mode1 =  31.5-82.0,  50.0-90.0, +, +, 1280, 1024

[CPQ-151FS]
Desc = COMPAQ 151FS Color Monitor
MonId =  6

Mode1 =  31.5-57.0,  50.0-90.0, +, +, 1024,  768

[CPQ-152FS]
Desc = COMPAQ 152FS Color Monitor
MonId =  6

Mode1 =  31.5-57.0,  50.0 90.0, +, +, 1024,  768

[CPQ-171FS]
Desc = COMPAQ 171FS Color Monitor
MonId =  4

Mode1 =  31.5-82.0,  50.0-90.0, +, +, 1280, 1024

[CPQ-172FS]
Desc = COMPAQ 172FS Color Monitor
MonId =  4

Mode1 =  31.5-82.0,  50.0-90.0, +, +, 1280, 1024

[CM-8426]
Desc = Aamazing Technologies, Inc. model CM-8426

Mode1 =  31.0-60.0,  40.0-80.0, +, +, 1024,  768

[MS-8431]
Desc = Aamazing Technologies, Inc. model MS-8431

Mode1 =  15.0-36.0,  50.0-70.0, +, +, 1024,  768

[7015]
Desc = Acer America Corp. model 7015

Mode1 =  15.0-36.0,  45.0-90.0, +, +,  800,  600

[15P]
Desc = Acer America Corp. model 15P

Mode1 =  15.0-70.0,  45.0-90.0, +, +, 1024,  768
```

3

```
[33]
Desc = Acer America Corp. model 33

Mode1 =  31.0-38.0,  50.0-90.0, +, +, 1024,  768

[35]
Desc = Acer America Corp. model 35

Mode1 =  30.0-55.0,  45.0-90.0, +, +, 1024,  768

[CX1557]
Desc = Actix Systems, Inc. model CX1557

Mode1 =  30.0-57.0, 40.0-100.0, +, +, 1024, 768

[AML-1402]
Desc = Adara Technology, Inc. model AML-1402

Mode1 =  15.0-36.0,  45.0-90.0, +, +, 1024,  768

[AML-2001]
Desc = Adara Technology, Inc. model AML-2001

Mode1 =  30.0-36.5,  50.0-90.0, +, +, 1024,  768

[SM-5514B]
Desc = ADI Systems, Inc. model Microscan 2E SM-5514B

Mode1 =  30.0-38.0, 50.0-100.0, +, +, 1024,  768

[SM-5514A]
Desc = ADI Systems, Inc. model Microscan 3E SM-5514A

Mode1 =  30.0-50.0, 50.0-100.0, +, +, 1024,  768

[SM-5514E]
Desc = ADI Systems, Inc. model Microscan 3E+ SM-5514E

Mode1 =  30.0-58.0, 50.0-100.0, +, +, 1024,  768

[SM-5515]
Desc = ADI Systems, Inc. model Microscan 4A SM-5515

Mode1 =  30.0-58.0, 50.0-100.0, +, +, 1024,  768

[CM-324]
Desc = AOC International (U.S.A.), Ltd. model CM-324

Mode1 =  15.0-37.0,  50.0-90.0, +, +,  800,  600

[CM-325]
Desc = AOC International (U.S.A.), Ltd. model CM-325

Mode1 =  31.0-38.0,  50.0-90.0, +, +, 1024,  768

[CM-326]
Desc = AOC International (U.S.A.), Ltd. model CM-326

Mode1 =  15.0-38.0,  50.0-90.0, +, +, 1024,  768
```

4

```
[CRT-365]
Desc = AT&T Computer Systems model CRT-365

Mode1 =   30.0-75.0,  60.0-70.0, +, +, 1280, 1024

[CRT-395]
Desc = AT&T Computer Systems model CRT-395

Mode1 =  30.0-66.0,  50.0-90.0, +, +, 1280, 1024

[Bus_VGA]
Desc = Bus Computer Systems model Bus_VGA

Mode1 =  31.5-38.0,  50.0-70.0, +, +, 1024,  768

[CT1381A]
Desc = Carroll Touch model CT1381A

Mode1 =  15.7-38.0,  45.0-90.0, +, +,  800,  600

[EG2040]
Desc = Colorgraphic Communications Corp. model EG2040

Mode1 =  20.0-40.0, 40.0-100.0, +, +, 1024,  768

[CT-1458]
Desc = Compeq USA/Focus Technology model CT-1458

Mode1 =  15.0-48.0, 47.0-100.0, +, +, 1024,  768

[CT-1958]
Desc = Compeq USA/Focus Technology model CT-1958

Mode1 =  15.0-51.0, 47.0-100.0, +, +, 1024,  768

[7250]
Desc = Conrac Display Products, Inc. model 7250

Mode1 =  15.5-37.0,  47.0-80.0, +, +, 1024, 1024

[7351]
Desc = Conrac Display Products, Inc. model 7351

Mode1 =  62.5-67.5,  47.0-63.0, +, +, 1280, 1024

[7214]
Desc = Conrac Display Products, Inc. model 7214

Mode1 =  15.0-37.5,  48.0-90.0, +, +, 1024, 1024

[7241]
Desc = Conrac Display Products, Inc. model 7241

Mode1 =  15.0-37.0,  47.0-80.0, +, +, 1024, 1024

[7550]
Desc = Conrac Display Products, Inc. model 7550

Mode1 =  46.0-80.0,  47.0-80.0, +, +, 1600, 1200
```

5

```
[9250]
Desc = Conrac Display Products, Inc. model 9250

Mode1 =  15.0-37.5,  48.0-90.0, +, +, 1024, 1024

[7126]
Desc = Conrac Display Products, Inc. model 7126

Mode1 =  15.0-32.0,  48.0-75.0, +, +,  800,  600

[7211]
Desc = Conrac Display Products, Inc. model 7211

Mode1 =  15.0-37.0,  47.0-80.0, +, +, 1024, 1024

[CMC-141M]
Desc = Cordata Technologies, Inc. model CMC-141M

Mode1 =  15.5-39.0,  50.0-70.0, +, +, 1024,  768

[CMC-1500BF]
Desc = Cordata Technologies, Inc. model CMC-1500BF

Mode1 =  15.5-39.0,  50.0-90.0, +, +, 1024,  768

[CMC-1500M]
Desc = Cordata Technologies, Inc. model CMC-1500M

Mode1 =  30.0-65.0,  50.0-90.0, +, +, 1280, 1024

[CMC-1500TF]
Desc = Cordata Technologies, Inc. model CMC-1500TF

Mode1 =  31.47,      50.0-90.0, +, +,  640,  480
Mode2 =  35.0-38.5,  50.0-90.0, +, +, 1024,  768

[CMC-1700M]
Desc = Cordata Technologies, Inc. model CMC-1700M

Mode1 =  30.0-65.0,  50.0-90.0, +, +, 1280, 1024

[CMC-2100H]
Desc = Cordata Technologies, Inc. model CMC-2100H

Mode1 =  60.0-65.0,  50.0-85.0, +, +, 1280, 1024

[CMC-2100M]
Desc = Cordata Technologies, Inc. model CMC-2100M

Mode1 =  30.0-65.0,  50.0-90.0, +, +, 1280, 1024

[CPS-1460]
Desc = CTX International, Inc. model CPS-1460

Mode1 =  30.0-60.0,  50.0-90.0, +, +, 1024,  768

[CPS-1560]
Desc = CTX International, Inc. model CPS-1560
```

6

```
Mode1 =  30.0-60.0,  50.0-90.0, +, +, 1024,  768

[CPS-1750]
Desc = CTX International, Inc. model CPS-1750

Mode1 =  30.0-60.0,  50.0-90.0, +, +, 1024,  768

[CPS-1760]
Desc = CTX International, Inc. model CPS-1760

Mode1 =  30.0-65.0,  50.0-90.0, +, +, 1280, 1024

[CPS-2160]
Desc = CTX International, Inc. model CPS-2160

Mode1 =  30.0-65.0, 50.0-100.0, +, +, 1280, 1024

[CPS-2180]
Desc = CTX International, Inc. model CPS-2180

Mode1 =  30.0-80.0, 50.0-100.0, +, +, 1280, 1024

[CVS-3450]
Desc = CTX International, Inc. model CVS-3450

Mode1 =  20.0-38.0,  50.0-90.0, +, +, 1024,  768

[CVS-3436]
Desc = CTX International, Inc. model CVS-3436

Mode1 =  15.0-38.0,  50.0-90.0, +, +, 1024,  768

[CVP-5439]
Desc = CTX International, Inc. model CVP-5439

Mode1 =  30.0-35.0,  50.0-90.0, +, +, 1024,  768

[CVP-5468]
Desc = CTX International, Inc. model CVP-5468

Mode1 =  30.0-38.0,  50.0-90.0, +, +, 1024,  768

[CVP-5468NL]
Desc = CTX International, Inc. model CVP-5468NL

Mode1 =  30.0-38.0,  50.0-90.0, +, +, 1024,  768

[CVP-5468NI]
Desc = CTX International, Inc. model CVP-5468NI

Mode1 =  30.0-38.0,  50.0-90.0, +, +, 1024,  768
Mode2 =  44.0-50.0,  50.0-90.0, +, +, 1024,  768

[Multiscan-3436]
Desc = CTX International, Inc. model Multiscan 3436

Mode1 =  15.0-38.0,  50.0-90.0, +, +, 1024,  768

[TSM-1431]
Desc = Darius Technology, Ltd. model TSM-1431
```

```
Mode1 =  15.5-39.0,  50.0-90.0, +, +, 1024,  768

[GPD-16C]
Desc = Dell Computer Corp. model GPD-16C

Mode1 =  30.0-64.0,  50.0-90.0, +, +, 1280, 1024

[GPD-19C]
Desc = Dell Computer Corp. model GPD-19C

Mode1 =  30.0-64.0,  50.0-90.0, +, +, 1280, 1024

[Dell_VGA]
Desc = Dell Computer Corp. model Dell_VGA

Mode1 =  31.5-35.0,  56.0,      +, +,  800,  600
Mode2 =  31.5-35.0,  60.0,      +, +,  800,  600
Mode3 =  31.5-35.0,  70.0,      +, +,  800,  600

[Eversync_SVGA]
Desc = Everex Systems, Inc. model Eversync_SVGA

Mode1 =  15.5-35.0,  50.0-70.0, +, +, 1024,  768

[FMS]
Desc = Falco Data Products, Inc. model FMS

Mode1 =  15.0-38.0,  47.0-90.0, +, +, 1024,  768

[MON-7C5]
Desc = Fora, Inc. model MON-7C5

Mode1 =  15.0-36.0,  45.0-90.0, +, +,  800,  600

[MTS-9608S]
Desc = Forefront Technology Corp. model MTS-9608S

Mode1 =  15.0-38.0,  50.0-90.0, +, +, 1024,  768

[PVGA-1024A]
Desc = Fujikama O.A. Distribution model PVGA-1024A

Mode1 =  31.5-38.5,  50.0-90.0, +, +, 1024,  768

[TY-1411]
Desc = Golden Dragon model TY-1411

Mode1 =  15.5-37.0, 50.0-120.0, +, +, 1024,  768

[TY-2015]
Desc = Golden Dragon model TY-2015

Mode1 =  30.0-65.0,  49.0-88.0, +, +, 1280, 1024

[1423]
Desc = GoldStar Technology, Inc. model 1423

Mode1 =  31.5,          60.0, -, -,  640,  480
Mode1 =  31.5,          70.0, -, -,  640,  480
```

```
[1423+VGA]
Desc = GoldStar Technology, Inc. model 1423 Plus VGA

Mode1 =  31.5,          50.0, -, -,  640,  480
Mode2 =  31.5,          60.0, -, -,  640,  480
Mode3 =  31.5,          70.0, -, -,  640,  480

[1453_Plus]
Desc = GoldStar Technology, Inc. model 1453 Plus

Mode1 =  31.5,          60.0, -, -, 1024,  768
Mode2 =  31.5,          70.0, -, -, 1024,  768
Mode3 =  35.2,          60.0, +, +, 1024,  768
Mode4 =  35.2,          70.0, +, +, 1024,  768
Mode5 =  35.2,          87.0, +, +, 1024,  768
Mode6 =  35.5,          60.0, +, +, 1024,  768
Mode7 =  35.5,          70.0, +, +, 1024,  768
Mode8 =  35.5,          87.0, +, +, 1024,  768

[1460+VGA]
Desc = GoldStar Technology, Inc. model 1460 Plus VGA

Mode1 =  31.5,          50.0, -, -, 1024,  768
Mode2 =  31.5,          60.0, -, -, 1024,  768
Mode3 =  31.5,          70.0, -, -, 1024,  768
Mode4 =  35.2,          60.0, +, +, 1024,  768
Mode5 =  35.2,          70.0, +, +, 1024,  768
Mode6 =  35.5,          60.0, +, +, 1024,  768
Mode7 =  35.5,          70.0, +, +, 1024,  768
Mode8 =  48.0,          60.0, +, +, 1024,  768
Mode9 =  48.0,          70.0, +, +, 1024,  768

[1470_Plus]
Desc = GoldStar Technology, Inc. model 1470_Plus

Mode1 =  30.0-50.0,  45.0-90.0, +, +, 1024,  768

[1490]
Desc = GoldStar Technology, Inc. model 1490

Mode1 =  30.0-64.0, 50.0-120.0, +, +, 1280, 1024

[1510]
Desc = GoldStar Technology, Inc. model 1510

Mode1 =  30.0-60.0, 50.0-105.0, +, +, 1024,  768

[1620]
Desc = GoldStar Technology, Inc. model 1620

Mode1 =  30.0-50.0,  45.0-90.0, +, +, 1024,  768

[1710]
Desc = GoldStar Technology, Inc. model 1710

Mode1 =  30.0-60.0, 50.0-105.0, +, +, 1024,  768

[Maxiscan]
Desc = HCI model Maxiscan
```

```
Mode1 =  15.0-35.0,  50.0-70.0, +, +, 1024,  768

[D1187A]
Desc = Hewlett-Packard Co. model D1187A

Mode1 =  30.0-64.0,  50.0-90.0, +, +, 1280, 1024

[D1188A]
Desc = Hewlett-Packard Co. model D1188A

Mode1 =  30.0-64.0,  50.0-90.0, +, +, 1280, 1024

[20-AS]
Desc = Hitachi America, Ltd. model 20-AS

Mode1 =  30.0-65.0,  55.0-80.0, +, +, 1280, 1024

[20-AP]
Desc = Hitachi America, Ltd. model 20-AP

Mode1 =  30.0-65.0,  55.0-80.0, +, +, 1280, 1024

[20-APF]
Desc = Hitachi America, Ltd. model 20-APF

Mode1 =  30.0-65.0,  55.0-80.0, +, +, 1280, 1024

[21-AP]
Desc = Hitachi America, Ltd. model 21-AP

Mode1 =  30.0-65.0,  55.0-80.0, +, +, 1280, 1024

[HM-5219]
Desc = Hitachi America, Ltd. model HM-5219

Mode1 =  78.0-80.0,  88.0-89.0, +, +, 1600, 1280
Mode2 =  88.0-90.0,  88.0-89.0, +, +, 1600, 1280

[8504]
Desc = IBM, Inc. model 8504

Mode1 =       31.5,       70.0, -, -,  640,  480

[8506]
Desc = IBM, Inc. model 8506

Mode1 =       50.5,       70.8, +, +,  864, 1200
Mode2 =       50.5,       80.2, +, +,  864, 1200

[8508]
Desc = IBM, Inc. model 8508

Mode1 =       62.0,       93.5, +, +, 1600, 1200
Mode2 =       62.0,       98.6, +, +, 1600, 1200

[8511]
Desc = IBM, Inc. model 8511

Mode1 =       31.5,  50.0-70.0, -, -,  640,  480
```

```
[8515]
Desc = IBM, Inc. model 8515

Mode1 =       31.5,  50.0-70.0, -, -, 1024,  768
Mode2 =       35.5,  50.0-70.0, -, -, 1024,  768

[8518]
Desc = IBM, Inc. model 8518

Mode1 =       31.5,       60.0, -, -,  640,  480

[DR-3114]
Desc = Iiyama North America, Inc. model DR-3114

Mode1 =       31.5,  43.0-70.0, -, -, 1024, 768
Mode2 =       35.0,  43.0-70.0, +, +, 1024, 768
Mode3 =       35.5,  43.0-70.0, +, +, 1024, 768
Mode3 =       38.0,  43.0-70.0, +, +, 1024, 768

[MF-5014A]
Desc = Iiyama North America, Inc. model MF-5014A

Mode1 =  15.5-38.5,  50.0-90.0, +, +, 1024,  768

[MF-5015A]
Desc = Iiyama North America, Inc. model MF-5015A

Mode1 =  15.5-38.5,  50.0-90.0, +, +,  800,  600

[MF-5017]
Desc = Iiyama North America, Inc. model MF-5017

Mode1 =  15.0-40.0,  50.0-90.0, +, +, 1024,  768

[MF-5021]
Desc = Iiyama North America, Inc. model MF-5021

Mode1 =  15.5-38.5,  50.0-90.0, +, +, 1024,  768

[MF-5115]
Desc = Iiyama North America, Inc. model MF-5115

Mode1 =  21.8-50.0,  50.0-90.0, +, +, 1024,  768

[MF-5117]
Desc = Iiyama North America, Inc. model MF-5117

Mode1 =  20.0-50.0,  50.0-90.0, +, +, 1024,  768

[MF-5121A]
Desc = Iiyama North America, Inc. model MF-5121A

Mode1 =  30.0-65.0,  50.0-90.0, +, +, 1280, 1024

[MF-5214A]
Desc = Iiyama North America, Inc. model MF-5214A

Mode1 =  30.0-38.5,  50.0-90.0, +, +, 1024,  768
```

11

```
[MF-5215A]
Desc = Iiyama North America, Inc. model MF-5215A

Mode1 =  30.0-38.5,  50.0-90.0, +, +, 1024,  768

[MF-5217]
Desc = Iiyama North America, Inc. model MF-5217

Mode1 =  30.0-60.0,  50.0-90.0, +, +, 1280, 1024

[MF-5221]
Desc = Iiyama North America, Inc. model MF-5221

Mode1 =  30.0-80.0,  50.0-90.0, +, +, 1280, 1280

[MR-5314]
Desc = Iiyama North America, Inc. model MR-5314

Mode1 =  30.0-60.0,  50.0-90.0, +, +, 1024,  768

[MF-5315]
Desc = Iiyama North America, Inc. model MF-5315

Mode1 =  30.0-68.0,  50.0-90.0, +, +, 1280, 1024

[MF-5317]
Desc = Iiyama North America, Inc. model MF-5317

Mode1 =  30.0-65.0,  50.0-90.0, +, +, 1280, 1024

[MF-5321]
Desc = Iiyama North America, Inc. model MF-5321

Mode1 =  30.0-80.0,  50.0-90.0, +, +, 1280, 1280

[MF-5421]
Desc = Iiyama North America, Inc. model MF-5421

Mode1 =  30.0-80.0,  50.0-90.0, +, +, 1600, 1280

[MF-5621]
Desc = Iiyama North America, Inc. model MF-5621

Mode1 =  30.0-80.0,  50.0-90.0, +, +, 1600, 1280

[MF-8217]
Desc = Iiyama North America, Inc. model VisionMaster MF-8217

Mode1 =  30.0-60.0,  50.0-90.0, +, +, 1024,  768

[MF-8317]
Desc = Iiyama North America, Inc. model VisionMaster MF-8317

Mode1 =  30.0-65.0,  50.0-90.0, +, +, 1280, 1024

[C/CDE-165VB]
Desc = Ikegami Electronics, Inc. model C/CDE-165VB

Mode1 =  48.0-64.0,  50.0-70.0, +, +, 1280, 1024
```

12

```
[C/DM-2010A]
Desc = Ikegami Electronics, Inc. model C/DM-2010A

Mode1 =  48.0-64.0,  50.0-70.0, +, +, 1280, 1024

[C/DM-2060]
Desc = Ikegami Electronics, Inc. model C/DM-2060

Mode1 =  48.0-64.0,  50.0-70.0, +, +, 1280, 1024

[CT-20]
Desc = Ikegami Electronics, Inc. model CT-20

Mode1 =  48.0-64.0,  50.0-70.0, +, +, 1280, 1024

[CN-20]
Desc = Ikegami Electronics, Inc. model CN-20

Mode1 =  45.0-68.0, 50.0-150.0, +, +, 1280, 1024

[C21LMAX]
Desc = Image Systems Corp. model C21LMAX

Mode1 =  48.0-96.0,  60.0-80.0, +, +, 1600, 1280

[M24LMAX]
Desc = Image Systems Corp. model M24LMAX

Mode1 =  48.0-96.0,  60.0-80.0, +, +, 2000, 1500

[CM-1403]
Desc = Intra Electronics USA, Inc. model CM-1403

Mode1 =  15.0-38.0, 40.0-100.0, +, +, 1024,  768

[CM-7126]
Desc = Iocomm International Technology Corp. model CM-7126

Mode1 =  30.0-75.0,  50.0-90.0, +, +, 1280, 1024

[GD-H4220US]
Desc = JVC Information Products Co. model GD-H4220US

Mode1 =  15.0-37.0,  45.0-87.0, +, +, 1024,  768

[CA-17]
Desc = KFC Computek Components Corp. model CA-17

Mode1 =  30.0-64.0, 50.0-100.0, +, +, 1280, 1024

[CH-14]
Desc = KFC Computek Components Corp. model CH-14

Mode1 =  15.0-36.0,  50.0-86.0, +, +, 1024,  768

[CM-14]
Desc = KFC Computek Components Corp. model CM-14

Mode1 =  30.0-64.0,  50.0-90.0, +, +, 1024,  768
```

13

```
[MN275]
Desc = KLH Computers model MN275

Mode1 =  31.5,        50.0-90.0, +, +,  640,  480
Mode2 =  34.5-38.5,   50.0-90.0, +, +, 1024,  768

[1730S]
Desc = Leading Technology, Inc. model 1730S

Mode1 =  21.0-50.0,   50.0-90.0, +, +, 1024,  768

[CE-8]
Desc = Link Computer, Inc. model CE-8

Mode1 =  15.5-38.0,   50.0-90.0, +, +, 1024,  768

[CM-3]
Desc = Link Computer, Inc. model CM-3

Mode1 =  15.5-36.0,   50.0-70.0, +, +,  800,  600

[CM-2090M]
Desc = Lite-On, Inc. model CM-2090M

Mode1 =  30.0-75.0, 40.0-120.0, +, +, 1280, 1024

[Colorview/15]
Desc = Mag Computronic (USA) Inc. model Colorview/15

Mode1 =  30.0-68.0, 50.0-120.0, +, +, 1280, 1024

[PMV-14AC/plus]
Desc = Mag Computronic (USA) Inc. model PMV-14AC/plus

Mode1 =  15.0-36.0,   45.0-90.0, +, +, 1024,  768

[MX15F]
Desc = MAG Innovision, Inc. model MX15F

Mode1 =  30.0-68.0, 50.0-120.0, +, +, 1280, 1024

[MX17F/S]
Desc = MAG Innovision, Inc. model MX17F/S

Mode1 =  30.0-68.0, 50.0-120.0, +, +, 1280, 1024

[MX21NT]
Desc = MAG Innovision, Inc. model MX21NT

Mode1 =  30.0-82.0, 50.0-120.0, +, +, 1600, 1280

[PMV-1531]
Desc = Mag Computronic (USA) Inc. model PMV-1531

Mode1 =  15.0-38.0,   45.0-90.0, +, +, 1024,  768

[1020/LP]
Desc = Microvitec, Inc. model 1020/LP

Mode1 =  15.0-36.5, 45.0-100.0, +, +, 1024,  768
```

14

```
[1020/SP]
Desc = Microvitec, Inc. model 1020/SP

Mode1 =  15.0-36.5, 45.0-100.0, +, +, 1024,  768

[2012/LP]
Desc = Microvitec, Inc. model 2012/LP

Mode1 =  15.0-40.0, 45.0-100.0, +, +,  800,  600

[2014/LP]
Desc = Microvitec, Inc. model 2014/LP

Mode1 =  15.0-40.0, 45.0-100.0, +, +,  800,  600

[2014/SVGA]
Desc = Microvitec, Inc. model 2014/SVGA

Mode1 =  30.0-40.0,   45.0-90.0, +, +, 1024,  768

[2019/SP]
Desc = Microvitec, Inc. model 2019/SP

Mode1 =  15.0-38.0, 45.0-100.0, +, +, 1024,  768

[4015/FST]
Desc = Microvitec, Inc. model 4015/FST

Mode1 =  30.0-50.0, 45.0-100.0, +, +, 1024,  768

[604/FST]
Desc = Microvitec, Inc. model 604/FST

Mode1 =  15.0-36.5, 45.0-100.0, +, +, 1024,  768

[704/FST]
Desc = Microvitec, Inc. model 704/FST

Mode1 =  15.0-36.5, 45.0-100.0, +, +, 1024,  768

[710MH]
Desc = Mitsuba Corp. model 710MH

Mode1 =  15.0-38.0,   50.0-90.0, +, +, 1024,  768

[AUM-1381A]
Desc = Mitsubishi Electronics America, Inc. model AUM-1381A

Mode1 =  15.7-38.0,   45.0-90.0, +, +, 1024,  768

[FA-3425]
Desc = Mitsubishi Electronics America, Inc. model FA-3425

Mode1 =  15.7-35.5,   50.0-87.0, +, +, 1024,  768

[HL-6605]
Desc = Mitsubishi Electronics America, Inc. model HL-6605

Mode1 =  30.0-64.0,   50.0-90.0, +, +, 1280, 1024
```

15

```
[HC-3905ATK]
Desc = Mitsubishi Electronics America, Inc. model HC-3905ATK

Mode1 =  15.7-38.0,  45.0-90.0, +, +, 1024,  768

[HL-6935]
Desc = Mitsubishi Electronics America, Inc. model HL-6935

Mode1 =  30.0-64.0,  50.0-90.0, +, +, 1280, 1024

[FA-3415]
Desc = Mitsubishi Electronics America, Inc. model FA-3415

Mode1 =  15.7-35.5,  50.0-87.0, +, +, 1024,  768

[FA-3435]
Desc = Mitsubishi Electronics America, Inc. model FA-3435

Mode1 =  15.7-35.5,  50.0-87.0, +, +, 1024,  768

[FHL-6115STK]
Desc = Mitsubishi Electronics America, Inc. model FHL-6115STK

Mode1 =  30.0-64.0, 50.0-120.0, +, +, 1280, 1024

[FHL-6115SBK]
Desc = Mitsubishi Electronics America, Inc. model FHL-6115SBK

Mode1 =  30.0-64.0, 50.0-120.0, +, +, 1280, 1024

[FL-6615ATK]
Desc = Mitsubishi Electronics America, Inc. model FL-6615ATK

Mode1 =  30.0-64.0, 50.0-120.0, +, +, 1280, 1024

[HC-3505SK]
Desc = Mitsubishi Electronics America, Inc. model HC-3505SK

Mode1 =  15.7-38.0,  45.0-90.0, +, +, 1024,  768

[HJ-6505SK]
Desc = Mitsubishi Electronics America, Inc. model HJ-6505SK

Mode1 =  45.0-70.0,  50.0-80.0, +, +, 1280, 1024

[HJ-6505SAK]
Desc = Mitsubishi Electronics America, Inc. model HJ-6505SAK

Mode1 =  45.0-70.0,  50.0-80.0, +, +, 1280, 1024

[HJ-6905SBK]
Desc = Mitsubishi Electronics America, Inc. model HJ-6905SBK

Mode1 =  40.0-70.0,  50.0-80.0, +, +, 1280, 1024

[HL-6615]
Desc = Mitsubishi Electronics America, Inc. model HL-6615

Mode1 =  30.0-64.0, 50.0-120.0, +, +, 1024,  768
```

16

```
[HL-6915SATK]
Desc = Mitsubishi Electronics America, Inc. model HL-6915SATK

Mode1 =  30.0-64.0, 50.0-120.0, +, +, 1280, 1024

[HL-6915SSBK]
Desc = Mitsubishi Electronics America, Inc. model HL-6915SSBK

Mode1 =  30.0-64.0, 50.0-120.0, +, +, 1280, 1024

[XC-3315C]
Desc = Mitsubishi Electronics America, Inc. model XC-3315C

Mode1 =  15.0-36.0, 40.0-120.0, +, +,  800,  600

[XC-3715C]
Desc = Mitsubishi Electronics America, Inc. model XC-3715C

Mode1 =  15.0-36.0, 45.0-120.0, +, +,  800,  600

[XC-3725C]
Desc = Mitsubishi Electronics America, Inc. model XC-3725C

Mode1 =  24.0-64.0,  45.0-90.0, +, +, 1280, 1024

[AM-2751A]
Desc = Mitsubishi Electronics America, Inc. model AM-2751A

Mode1 =  15.6-36.0,  45.0-90.0, +, +,  800,  600

[AM-3151A]
Desc = Mitsubishi Electronics America, Inc. model AM-3151A

Mode1 =  15.6-36.0,  45.0-90.0, +, +,  800,  600

[AM-3501R]
Desc = Mitsubishi Electronics America, Inc. model AM-3501R

Mode1 =  15.0-35.5,  45.0-70.0, +, +,  800,  600

[MG-3200]
Desc = Modgraph, Inc. model MG-3200

Mode1 =  15.0-35.0,  47.0-80.0, +, +,  800,  600

[MX-200MC]
Desc = Monitronix, Inc. model MX-200MC

Mode1 =  15.0-75.0, 40.0-120.0, +, +, 1280, 1024

[MX-210EZ]
Desc = Monitronix, Inc. model MX-210EZ

Mode1 =  30.0-75.0, 40.0-120.0, +, +, 1280, 1024

[MX-240EZ]
Desc = Monitronix, Inc. model MX-240EZ

Mode1 =  30.0-75.0, 40.0-120.0, +, +, 1600, 1280
```

17

```
[MX240]
Desc = Monitronix, Inc. model MX240

Mode1 =  30.0-90.0, 20.0-120.0, +, +, 1600, 1280

[Morse]
Desc = Morse Technology, Inc.

Mode1 =  30.0-57.0,  50.0-90.0, +, +, 1024,  768

[6300]
Desc = NANAO USA Corp. model 6300

Mode1 =  31.5,       60.0-80.0, +, +,  640,  480
Mode2 =  48.0-55.0,  60.0-80.0, +, +, 1280, 1024
Mode3 =  64.0-78.0,  60.0-80.0, +, +, 1664, 1200

[9060S]
Desc = NANAO USA Corp. model 9060S

Mode1 =  15.5-38.5,  50.0-90.0, +, +, 1024,  768

[9065S]
Desc = NANAO USA Corp. model 9065S

Mode1 =  30.0-49.0,  50.0-90.0, +, +, 1024,  768

[9070U]
Desc = NANAO USA Corp. model 9070U

Mode1 =  20.0-50.0,  50.0-90.0, +, +, 1024,  768

[9080i]
Desc = NANAO USA Corp. model 9080i

Mode1 =  30.0-64.0,  50.0-90.0, +, +, 1024,  768

[9400i]
Desc = NANAO USA Corp. model 9400i

Mode1 =  30.0-65.0,  55.0-90.0, +, +, 1280, 1024

[9500]
Desc = NANAO USA Corp. model 9500

Mode1 =  31.5,       55.0-75.0, +, +,  640,  480
Mode2 =  48.0-50.0,  55.0-75.0, +, +, 1024,  768
Mode3 =  64.0-78.0,  55.0-75.0, +, +, 1280, 1024

[T560i]
Desc = NANAO USA Corp. model T660

Mode1 =  30.0-80.0,  55.0-90.0, +, +, 1280, 1024

[T660i]
Desc = NANAO USA Corp. model T660i

Mode1 =  30.0-80.0,  55.0-90.0, +, +, 1280, 1024
```

TOOLS

18

```
[F340iW]
Desc = NANAO USA Corp. model F340iW

Mode1 =  27.0-61.0,  55.0-90.0, +, +, 1024,  768

[F550i]
Desc = NANAO USA Corp. model F550i

Mode1 =  30.0-65.0,  55.0-90.0, +, +, 1280, 1024

[F750i]
Desc = NANAO USA Corp. model F750i

Mode1 =  30.0-80.0,  55.0-90.0, +, +, 1280, 1024

[NEC-3D]
Desc = NEC Technologies, Inc. model NEC-3D

Mode1 =  15.0-38.0,  50.0-80.0, +, +, 1024,  768

[NEC-3FGx]
Desc = NEC Technologies, Inc. model NEC-3FGx

Mode1 =  31.0-38.5,  55.0-90.0, +, +, 1024,  768
Mode2 =  47.8-49.0,  55.0-90.0, +, +, 1024,  768

[NEC-4D]
Desc = NEC Technologies, Inc. model NEC-4D

Mode1 =  31.5-57.0,  50.0-90.0, +, +, 1024,  768

[NEC-4FG]
Desc = NEC Technologies, Inc. model NEC-4FG

Mode1 =  27.0-57.0,  55.0-90.0, +, +, 1024,  768

[NEC-5D]
Desc = NEC Technologies, Inc. model NEC-5D

Mode1 =  31.5-66.0,  50.0-90.0, +, +, 1280, 1024

[NEC-5FG]
Desc = NEC Technologies, Inc. model NEC-5FG

Mode1 =  27.0-79.0,  55.0-90.0, +, +, 1280, 1024

[NEC-6FG]
Desc = NEC Technologies, Inc. model NEC-6FG

Mode1 =  27.0-79.0,  55.0-90.0, +, +, 1280, 1024

[CM1483M]
Desc = Nissei Sangyo America, Ltd. model CM1483M

Mode1 =  30.0-40.0, 50.0-120.0, +, +, 1024,  768

[CM1584MU]
Desc = Nissei Sangyo America, Ltd. model CM1584MU

Mode1 =  30.0-58.0, 50.0-100.0, +, +, 1024,  768
```

D:\WINDOWS\CPQMON.INI

```
[CM1785MU]
Desc = Nissei Sangyo America, Ltd. model CM1785MU

Mode1 =  30.0-64.0, 50.0-100.0, +, +, 1280, 1024

[CM2085MU]
Desc = Nissei Sangyo America, Ltd. model CM2085MU

Mode1 =  30.0-64.0, 50.0-120.0, +, +, 1280, 1024

[CM2086A]
Desc = Nissei Sangyo America, Ltd. model CM2086A

Mode1 =  46.0-64.0,  55.0-65.0, +, +, 1280, 1024

[CM2087MU]
Desc = Nissei Sangyo America, Ltd. model CM2087MU

Mode1 =  30.0-78.0, 50.0-120.0, +, +, 1280, 1024

[CM2186AF]
Desc = Nissei Sangyo America, Ltd. model CM2186AF

Mode1 =  60.0-65.0,  60.0-70.0, +, +, 1280, 1024

[CM2187MU]
Desc = Nissei Sangyo America, Ltd. model CM2187MU

Mode1 =  30.0-78.0, 50.0-120.0, +, +, 1600, 1200

[CM2085M]
Desc = Nissei Sangyo America, Ltd. model CM2085M

Mode1 =  30.0-64.0, 50.0-120.0, +, +, 1280, 1024

[Optiquest_1000]
Desc = Optiquest model Optiquest_1000

Mode1 =  30.0-48.0,  47.0-90.0, +, +, 1024,  768

[Optiquest_3000]
Desc = Optiquest model Optiquest_3000

Mode1 =  30.0-55.0,  45.0-90.0, +, +, 1024,  768

[Optiquest_4000]
Desc = Optiquest model Optiquest_4000

Mode1 =  30.0-76.0, 40.0-120.0, +, +, 1280, 1024

[PB8510SV]
Desc = Packard Bell model PB8510SV

Mode1 =  30.0-37.0,  50.0-90.0, +, +, 1024,  768

[PB8528SVG]
Desc = Packard Bell model PB8528SVG

Mode1 =  31.5-38.0,  55.0-87.0, +, +, 1024,  768
```

```
[C1381]
Desc = Panasonic Comm. & Systems Co. model C1381

Mode1 =  30.0-38.0,  50.0-90.0, +, +, 1024,  768

[C1391]
Desc = Panasonic Comm. & Systems Co. model C1391

Mode1 =  15.5-36.0,  40.0-80.0, +, +, 1024,  768

[C1395]
Desc = Panasonic Comm. & Systems Co. model C1395

Mode1 =  30.0-57.0,  50.0-90.0, +, +, 1024,  768

[C1795]
Desc = Panasonic Comm. & Systems Co. model C1795

Mode1 =  30.0-79.0,  50.0-90.0, +, +, 1280, 1024

[C1991]
Desc = Panasonic Comm. & Systems Co. model C1991

Mode1 =  30.0-68.0,  50.0-90.0, +, +, 1280, 1024

[TX-1703MAA]
Desc = Panasonic Comm. & Systems Co. model TX-1703MAA

Mode1 =  30.0-64.0,  50.0-90.0, +, +, 1280, 1024

[TX-2013MAA]
Desc = Panasonic Comm. & Systems Co. model TX-2013MAA

Mode1 =  30.0-64.0,  50.0-90.0, +, +, 1280, 1024

[TX-2103MAA]
Desc = Panasonic Comm. & Systems Co. model TX-2103MAA

Mode1 =  30.0-64.0,  50.0-90.0, +, +, 1280, 1024

[Super_VGA]
Desc = PC Brand, Inc. model Super_VGA

Mode1 =  28.0-38.0,  50.0-90.0, +, +, 1024,  768

[6CM321]
Desc = Philips Consumer Electronics Co., model 6CM321

Mode1 =  31.5,       50.0-90.0, -, -,  640,  480
Mode2 =  35.2,       50.0-90.0, +, +,  800,  600

[7BM749]
Desc = Philips Consumer Electronics Co., model 7BM749

Mode1 =  31.5,       60.0-70.0, -, -,  640,  480

[7CM321]
Desc = Philips Consumer Electronics Co., model 7CM321
```

21

```
Mode1 =  31.5,        50.0-90.0, -, -,  640,  480
Mode2 =  35.2,        50.0-90.0, +, +, 1024,  768
Mode3 =  35.5,        50.0-90.0, +, +, 1024,  768

[7CM329]
Desc = Philips Consumer Electronics Co., model 7CM329

Mode1 =  31.5,        50.0-90.0, -, -,  640,  480
Mode2 =  35.2,        50.0-90.0, +, +, 1024,  768
Mode3 =  35.5,        50.0-90.0, +, +, 1024,  768

[9CM062]
Desc = Philips Consumer Electronics Co., model 9CM062

Mode1 =  31.5,        60.0-70.0, -, -,  640,  480

[9CM082]
Desc = Philips Consumer Electronics Co., model 9CM082

Mode1 =  31.5,        60.0-70.0, -, -,  640,  480

[CM9039]
Desc = Philips Consumer Electronics Co., model CM9039

Mode1 =  31.5,        60.0-70.0, -, -,  640,  480

[CM9079]
Desc = Philips Consumer Electronics Co., model CM9079

Mode1 =  31.5,        50.0-90.0, -, -,  640,  480
Mode2 =  35.2,        50.0-90.0, +, +, 1024,  768
Mode3 =  35.5,        50.0-90.0, +, +, 1024,  768

[CM9085]
Desc = Philips Consumer Electronics Co., model CM9085

Mode1 =  31.5,              60.0, -, -,  640,  480
Mode2 =  31.5,              70.0, -, -,  640,  480

[CM9089]
Desc = Philips Consumer Electronics Co., model CM9089

Mode1 =  31.5,        50.0-90.0, -, -,  640,  480
Mode2 =  35.2,        50.0-90.0, +, +, 1024,  768
Mode3 =  35.5,        50.0-90.0, +, +, 1024,  768

[CM9214]
Desc = Philips Consumer Electronics Co., model CM9214

Mode1 =  30.0-58.0, 50.0-100.0, +, +, 1024,  768

[CM9217]
Desc = Philips Consumer Electronics Co., model CM9217

Mode1 =  30.0-57.0, 50.0-100.0, +, +, 1280, 1024

[20CM64]
Desc = Philips Consumer Electronics Co., model 20CM64

Mode1 =  30.0-64.0,  50.0-90.0, +, +, 1280, 1024
```

TOOLS

22

```
[PM14V-S-1]
Desc = Premier Computer Innovations model PM14V-S-1

Mode1 =  31.47,       50.0-90.0, +, +, 1024,  768
Mode2 =  34.5-38.5,   50.0-90.0, +, +, 1024,  768

[MAX-15]
Desc = Princeton Graphic Systems model MAX-15

Mode1 =  15.0-36.0, 45.0-120.0, +, +, 1024,  768

[Ultra-1200]
Desc = Princeton Graphic Systems model Ultra-1200

Mode1 =  15.0-38.0, 45.0-120.0, +, +, 1024,  768

[Ultra-1400]
Desc = Princeton Graphic Systems model Ultra-1400

Mode1 =  15.0-38.0, 45.0-120.0, +, +, 1024,  768

[Ultra-1600]
Desc = Princeton Graphic Systems model Ultra-1600

Mode1 =  15.0-38.0, 45.0-120.0, +, +, 1024,  768

[Ultra-2000]
Desc = Princeton Graphic Systems model Ultra-2000

Mode1 =  45.0-68.0, 50.0-150.0, +, +, 1280, 1024

[MultiView]
Desc = Princeton Publishing Labs model MultiView

Mode1 =  15.0-60.0,  45.0-90.0, +, +, 1024,  768

[MultiView_II]
Desc = Princeton Publishing Labs model MultiView_II

Mode1 =  15.0-70.0,  45.0-90.0, +, +, 1024,  768

[QM835]
Desc = Qume Corp. model QM835

Mode1 =  30.0-36.5,  50.0-90.0, +, +, 1024,  768

[PCD19]
Desc = Radius, Inc. model PrecisionColor Display/19

Mode1 =  30.0-67.0,        72.0, +, +, 1280, 1024

[PCD20]
Desc = Radius, Inc. model PrecisionColor Display/20

Mode1 =  30.0-71.0,        75.0, +, +, 1280, 1024

[PCP]
Desc = Radius, Inc. model PrecisionColor Pivot
```

D:\WINDOWS\CPQMON.INI

23

```
Mode1 =  30.0-60.0,  50.0-90.0, +, +, 1024,  768

[SRC-1401]
Desc = REDMS Group, Inc. model SRC-1401

Mode1 =  28.0-40.0,  47.0-90.0, +, +, 1024,  768

[SRC-1402]
Desc = REDMS Group, Inc. model SRC-1402

Mode1 =  28.0-50.0,  47.0-90.0, +, +, 1024,  768

[RE-1420]
Desc = Relisys model RE-1420

Mode1 =  28.0-40.0,  60.0,  .    +, +, 1024,  768

[RE-1520]
Desc = Relisys model RE-1520

Mode1 =  30.0-50.0,  50.0-80.0, +, +, 1024,  768

[RE-1528]
Desc = Relisys model RE-1528

Mode1 =  30.0-48.0,  50.0-90.0, +, +, 1024,  768

[RE-5155]
Desc = Relisys model RE-5155

Mode1 =  15.5-35.0,  50.0-70.0, +, +,  800,  600

[RM-1541]
Desc = Relisys model RM-1541

Mode1 =  48.0-65.0,  40.0-80.0, +, +, 1280, 1024

[KDM-1466]
Desc = Sampo Corp. of America model AlphaScan Plus

Mode1 =  30.0-60.0,  50.0-90.0, +, +, 1024,  768

[KDM-1566]
Desc = Sampo Corp. of America model AlphaScan 15

Mode1 =  30.0-65.0,  50.0-90.0, +, +, 1280, 1024

[KDM-1766]
Desc = Sampo Corp. of America model AlphaScan 17

Mode1 =  30.0-65.0, 50.0-100.0, +, +, 1280, 1024

[KDM-2055]
Desc = Sampo Corp. of America model AlphaScan LC

Mode1 =  30.0-60.0,  50.0-90.0, +, +, 1024,  768

[KDM-2066]
Desc = Sampo Corp. of America model AlphaScan LC
```

24

```
Mode1 =  30.0-67.0, 40.0-120.0, +, +, 1280, 1024

[CT-4581]
Desc = Samsung, Inc. model CT-4581

Mode1 =  15.0-38.0,  47.0-73.0, +, +,  800,  600

[CSA-7571]
Desc = Samsung, Inc. model CSA-7571

Mode1 =  20.0-50.0,  50.0-90.0, +, +, 1024,  768

[MF-4771]
Desc = Samsung, Inc. model MF-4771

Mode1 =  15.0-38.0,  48.0-72.0, +, +,  800,  600

[CM-1440]
Desc = Seiko Instruments U.S.A., Inc. model CM-1440

Mode1 =  31.0-40.0,  50.0-90.0, +, +, 1024,  768

[CM-1450]
Desc = Seiko Instruments U.S.A., Inc. model CM-1450

Mode1 =  31.0-50.0,  50.0-90.0, +, +, 1024,  768

[CM-2050]
Desc = Seiko Instruments U.S.A., Inc. model CM-2050

Mode1 =  31.0-50.0,  50.0-90.0, +, +, 1024,  768

[CPD-1302]
Desc = SONY Corporation of America model CPD-1302

Mode1 =  15.5-34.0, 50.0-100.0, +, +, 1024,  768

[CPD-1304]
Desc = SONY Corporation of America model CPD-1304

Mode1 =  28.0-50.0,  50.0-87.0, +, +, 1024,  768

[CPD-1304S]
Desc = SONY Corporation of America model CPD-1304S

Mode1 =  28.0-57.0, 55.0-110.0, +, +, 1024,  768

[CPD-1430]
Desc = SONY Corporation of America model CPD-1430

Mode1 =  28.0-58.0, 55.0-110.0, +, +, 1024,  768

[CPD-1730]
Desc = SONY Corporation of America model CPD-1730

Mode1 =  28.0-58.0, 55.0-115.0, +, +, 1024,  768

[GVM-1310]
Desc = SONY Corporation of America model GDM-1310
```

25

```
Mode1 =  15.7-36.0, 50.0-100.0, +, +, 1024,  768

[GVM-2020]
Desc = SONY Corporation of America model GVM-2020

Mode1 =  15.7-36.0, 50.0-100.0, +, +, 1024,  768

[GDM-1936]
Desc = SONY Corporation of America model GDM-1936

Mode1 =  30.0-71.0, 50.0-120.0, +, +, 1280, 1024

[GDM-2038]
Desc = SONY Corporation of America model GDM-2038

Mode1 =  28.0-85.0, 50.0-160.0, +, +, 1600, 1200

[Tuff/CRT]
Desc = Talon Technology Corp. model Tuff/CRT

Mode1 =  15.0-35.0,  47.0-73.0, +, +,  800,  600

[CM-1498M]
Desc = Tatung Co. of America, Inc. model CM-1498M

Mode1 =  31.5,       50.0-90.0, +, +,  640,  480
Mode2 =  35.5-37.5,  50.0-90.0, +, +, 1024,  768

[CM-1498R]
Desc = Tatung Co. of America, Inc. model CM-1498R

Mode1 =  31.5,       50.0-90.0, +, +,  640,  480
Mode2 =  35.5-37.5,  50.0-90.0, +, +, 1024,  768

[CM-1498T]
Desc = Tatung Co. of America, Inc. model CM-1498T

Mode1 =  31.5,       50.0-90.0, +, +,  640,  480
Mode2 =  35.5-37.5,  50.0-90.0, +, +, 1024,  768

[CM-1700]
Desc = Tatung Co. of America, Inc. model CM-1700

Mode1 =  31.0-65.0,  50.0-90.0, +, +, 1280, 1024

[CM-1495G]
Desc = Tatung Co. of America, Inc. model CM-1495G

Mode1 =  15.0-37.0, 40.0-120.0, +, +, 1024,  768

[CM-2000]
Desc = Tatung Co. of America, Inc. model CM-2000

Mode1 =  21.0-65.0, 43.0-100.0, +, +, 1280, 1024

[MM-1295]
Desc = Tatung Co. of America, Inc. model MM-1295

Mode1 =  15.0-35.0,  50.0-70.0, +, +,  800,  600
```

26

```
[MultiVision_770+]
Desc = TAXAN America, Inc. model MultiVision_770+

Mode1 =  15.0-37.0,  50.0-90.0, +, +,  800,  600

[MultiVision_795]
Desc = TAXAN America, Inc. model MultiVision_795

Mode1 =  30.0-57.0, 50.0-100.0, +, +, 1024,  768

[MultiVision_875]
Desc = TAXAN America, Inc. model MultiVision_875

Mode1 =  30.0-57.0,  50.0-90.0, +, +, 1024,  768

[UltraVision_1000]
Desc = TAXAN America, Inc. model UltraVision_1000

Mode1 =  30.0-37.0,  50.0-80.0, +, +,  800,  600
Mode2 =  48.0-52.0,  50.0-80.0, +, +, 1024,  768
Mode3 =  60.0-72.0,  50.0-80.0, +, +, 1024,  768

[UltraVision_1095]
Desc = TAXAN America, Inc. model UltraVision_1095

Mode1 =  28.0-80.0, 50.0-100.0, +, +, 1600, 1200

[UltraVision_1150]
Desc = TAXAN America, Inc. model UltraVision_1150

Mode1 =  30.0-37.0,  50.0-80.0, +, +,  800,  600
Mode2 =  48.0-52.0,  50.0-80.0, +, +, 1024,  768
Mode3 =  60.0-78.0,  50.0-80.0, +, +, 1600, 1200

[TE1491]
Desc = TECO Information Systems, Inc. model TE1491

Mode1 =  38.0-80.0, 45.0-100.0, +, +, 1024,  768

[TE1591]
Desc = TECO Information Systems, Inc. model TE1591

Mode1 =  30.0-50.0, 45.0-100.0, +, +, 1024,  768

[TE1791]
Desc = TECO Information Systems, Inc. model TE1791

Mode1 =  30.0-50.0, 45.0-100.0, +, +, 1024,  768

[TE2191]
Desc = TECO Information Systems, Inc. model TE2191

Mode1 =  60.0-66.0, 45.0-100.0, +, +, 1280, 1024

[P17CM00]
Desc = Toshiba, Inc. model P17CM00

Mode1 =  30.0-65.0,  50.0-90.0, +, +, 1280, 1024

[P17CM01]
```

27

```
Desc = Toshiba, Inc. model P17CM01

Mode1 =  30.0-65.0,  50.0-90.0, +, +, 1280, 1024

[P21CM00]
Desc = Toshiba, Inc. model P21CM00

Mode1 =  30.0-65.0,  50.0-90.0, +, +, 1280, 1024

[P21CR01]
Desc = Toshiba, Inc. model P21CR01

Mode1 =  30.0-65.0,  50.0-90.0, +, +, 1280, 1024

[P17CS01]
Desc = Toshiba, Inc. model P17CS01

Mode1 =  30.0-65.0,  50.0-90.0, +, +, 1280, 1024

[P17CU01]
Desc = Toshiba, Inc. model P17CU01

Mode1 =  30.0-57.0,  50.0-90.0, +, +, 1024,  768

[TTX3435AG]
Desc = TTX Computer Products, Inc. model TTX3435AG

Mode1 =  15.5-35.5,  50.0-70.0, +, +,  800,  600

[TTX3436AG]
Desc = TTX Computer Products, Inc. model TTX3436AG

Mode1 =  15.0-38.0,  50.0-90.0, +, +, 1024,  768

[TTX3450AG]
Desc = TTX Computer Products, Inc. model TTX3450AG

Mode1 =  20.0-38.0,  50.0-90.0, +, +, 1024,  768

[SuperSync_3+]
Desc = TVM Professional Monitor Corp. model SuperSync_3+

Mode1 =  15.0-38.0,  47.0-90.0, +, +, 1024,  768

[SuperSync_4A]
Desc = TVM Professional Monitor Corp. model SuperSync_4A

Mode1 =  31.0-38.0,  50.0-90.0, +, +, 1024,  768

[SuperSync_5A]
Desc = TVM Professional Monitor Corp. model SuperSync_5A

Mode1 =  31.0-48.0,  50.0-90.0, +, +, 1024,  768

[SuperSync_6A]
Desc = TVM Professional Monitor Corp. model SuperSync_6A

Mode1 =  31.0-65.0, 40.0-100.0, +, +, 1280, 1024

[SuperSync_7A]
```

28

```
Desc = TVM Professional Monitor Corp. model SuperSync_7A

Mode1 =  31.0-65.0, 40.0-100.0, +, +, 1280, 1024

[MG-11]
Desc = TVM Professional Monitor Corp. model MG-11

Mode1 =  15.0-38.0,  47.0-75.0, +, +, 1024,  768

[TM-5156H]
Desc = TW Casper Corp. model TM-5156H

Mode1 =  15.5-50.0,  60.0-70.0, +, +, 1024,  768

[TM-5414]
Desc = TW Casper Corp. model TM-5414

Mode1 =  15.5-35.0,  50.0-70.0, +, +, 1024,  768

[ViewSonic_4]
Desc = ViewSonic model ViewSonic 4

Mode1 =  20.0-38.0,  50.0-90.0, +, +, 1024,  768

[ViewSonic_4E]
Desc = ViewSonic model ViewSonic 4E

Mode1 =  31.5,       50.0-90.0, -, -,  640,  480
Mode2 =  35.5,       50.0-90.0, +, +, 1024,  768

[ViewSonic_5]
Desc = ViewSonic model ViewSonic 5

Mode1 =  31.0-55.0,  50.0-90.0, +, +, 1024,  768

[ViewSonic_5+]
Desc = ViewSonic model ViewSonic 5+

Mode1 =  31.0-57.0,  50.0-90.0, +, +, 1024,  768

[ViewSonic_5E]
Desc = ViewSonic model ViewSonic 5E

Mode1 =  31.0-60.0,  50.0-90.0, +, +, 1024,  768

[Viewsonic_6]
Desc = ViewSonic model Viewsonic 6

Mode1 =  30.0-50.0,  50.0-90.0, +, +, 1024,  768

[ViewSonic_7]
Desc = ViewSonic model ViewSonic 7

Mode1 =  30.0-64.0,  50.0-90.0, +, +, 1280, 1024

[ViewSonic_8]
Desc = ViewSonic model ViewSonic 8

Mode1 =  30.0-64.0,  50.0-90.0, +, +, 1280, 1024
```

29

```
[WY-670]
Desc = WYSE Technology model WY-670

Mode1 =  31.5,       55.0-87.0, +, +,  640,  480
Mode2 =  34.0-38.0,  55.0-87.0, +, +, 1024,  768

[WY-890N]
Desc = WYSE Technology model WY-890N

Mode1 =  38.5-51.0,  58.0-77.0, +, +, 1024,  768
```

TOOLS D:\WINDOWS\CPGMON.INI

30

APPENDIX B

Copyright 1993 Compaq Computer Corporation

1

```
;
;                    COMPAQ Video Mode Configuration File
;
;       This is the video mode configuration file for the COMPAQ Windows
;       drivers.  This file contains display mode information for all of
;       the COMPAQ video display adapters.  This file is in the Microsoft
;       standard .INI file format so that it can be read/written via the
;       Windows API.  The format is as follows:
;
;       [Video Controller]
;
;       ModeN = HScan, VScan, HRes, VRes, BPP, Memory, Pitch, Attr., Sect., Sect.
;
;       Where:
;
;         HScan          = Horizontal scan rate in kHz
;         VScan          = Vertical scan rate in Hz
;         HRes           = Horizontal resolution in pixels
;         VRes           = Vertical resolution in pixels
;         BPP            = Color depth in bits/pixel          [4 | 8 | 15 | 16 | 32]
;         Memory         = Memory size required in Kbytes [256 | 512 | 1024 | 2048]
;         Pitch          = Display pitch value in bytes
;         Attributes     = Attributes required to support this mode
;
;             PLL        DAC        ASIC
;             Type       Type       Type
;         ---------------------------------
;         |F|E|D|C|B|A|9|8|7|6|5|4|3|2|1|0|
;         ---------------------------------
;           | | | | | | | | | | | | | | | | -------> Starlight controller required
;           | | | | | | | | | | | | | | | ---------> Stardust controller required
;           | | | | | | | | | | | | | | -----------> Victory controller required
;           | | | | | | | | | | | | | -------------> V32 controller required
;           | | | | | | | | | | | | ---------------> ***** Reserved *****
;           | | | | | | | | | | | -------------------> 471 DAC required
;           | | | | | | | | | | ---------------------> 477 DAC required
;           | | | | | | | | | -----------------------> 484 DAC required
;           | | | | | | | | -------------------------> 485 DAC required
;           | | | | | | | ---------------------------> ***** Reserved *****
;           | | | | | | -----------------------------> VGA PLL required
;           | | | | | -------------------------------> Extended VGA PLL required
;           | | | | ---------------------------------> PLL-1 required
;           | | | -----------------------------------> PLL-3 required
;           | | -------------------------------------> ***** Reserved *****
;
;       Section(s)     = Section name(s) where mode parameters can be found
;
;       ***** WARNING *****
;
;       This file *CANNOT* exceed 64k in length, otherwise the Windows
;       GetPrivateProfile functions will fail! This file should also
;       contain *NO* TAB characters!
;
;       Define the CPQMode.INI File Version
;
[Version]
Version=GANYMEDE.1
;
;       IVGS Controller Modes
```

2

```
;
[IVGS]
Mode_640x480x4        = 31.5, 60.0,  640,  480,  4,  256,  320,  2113, IV04_640x480
;
;       AVGA Controller Modes
;
[AVGA]
Mode_640x480x4        = 31.5, 60.0,  640,  480,  4,  256,  320,  2178, AV04_640x480
Mode_800x600x4        = 38.0, 60.0,  800,  600,  4,  256,  400,  4226, AV04_800x600
Mode_640x480x8        = 31.5, 60.0,  640,  480,  8,  512, 1024,  2178, AV08_640x480
;
;       QVISION Controller Modes
;
[QVISION]
Mode_640x480x4_1      = 45.0, 75.0,  640,  480,  4,  256,  512, 24836, QV04_640x480_1
Mode_640x480x4_1a     = 45.0, 75.0,  640,  480,  4,  256,  512, 24840, QV04_640x480_1,
   QV_Setup_1024
Mode_640x480x4_2      = 31.5, 60.0,  640,  480,  4,  256,  512, 24836, QV04_640x480_2
Mode_640x480x4_2a     = 31.5, 60.0,  640,  480,  4,  256,  512, 24840, QV04_640x480_2,
   QV_Setup_1024
Mode_800x600x4_1      = 53.8, 75.0,  800,  600,  4,  512,  512, 24836, QV04_800x600_1
Mode_800x600x4_1a     = 53.8, 75.0,  800,  600,  4,  512,  512, 24840, QV04_800x600_1,
   QV_Setup_1024
Mode_800x600x4_2      = 37.8, 60.0,  800,  600,  4,  512,  512, 24836, QV04_800x600_2
Mode_800x600x4_2a     = 37.8, 60.0,  800,  600,  4,  512,  512, 24840, QV04_800x600_2,
   QV_Setup_1024
Mode_1024x768x4_1a    = 61.5, 76.0, 1024,  768,  4,  512,  512, 25096, QV04_1024x768_1
,  QV_Setup_1024
Mode_1024x768x4_2     = 57.0, 72.0, 1024,  768,  4,  512,  512, 24836, QV04_1024x768_2
Mode_1024x768x4_2a    = 57.0, 72.0, 1024,  768,  4,  512,  512, 24840, QV04_1024x768_2
,  QV_Setup_1024
Mode_1024x768x4_3     = 54.0, 66.0, 1024,  768,  4,  512,  512, 24836, QV04_1024x768_3
Mode_1024x768x4_3a    = 54.0, 66.0, 1024,  768,  4,  512,  512, 24840, QV04_1024x768_3
,  QV_Setup_1024
Mode_1024x768x4_4     = 48.0, 60.0, 1024,  768,  4,  512,  512, 24836, QV04_1024x768_4
Mode_1024x768x4_4a    = 48.0, 60.0, 1024,  768,  4,  512,  512, 24840, QV04_1024x768_4
,  QV_Setup_1024
Mode_1280x1024x4_1a   = 80.5, 76.0, 1280, 1024,  4, 1024, 1024, 25096, QV04_1280x1024_
1, QV_Setup_2048
Mode_1280x1024x4_2a   = 73.1, 68.0, 1280, 1024,  4, 1024, 1024, 25096, QV04_1280x1024_
2, QV_Setup_2048
Mode_1280x1024x4_3a   = 64.0, 60.0, 1280, 1024,  4, 1024, 1024, 25096, QV04_1280x1024_
3, QV_Setup_2048
Mode_640x480x8_1      = 45.0, 75.0,  640,  480,  8,  512, 1024, 24836, QV08_640x480_1
Mode_640x480x8_1a     = 45.0, 75.0,  640,  480,  8,  512, 1024, 24840, QV08_640x480_1,
   QV_Setup_1024
Mode_640x480x8_2      = 31.5, 60.0,  640,  480,  8,  512, 1024, 24836, QV08_640x480_2
Mode_640x480x8_2a     = 31.5, 60.0,  640,  480,  8,  512, 1024, 24840, QV08_640x480_2,
   QV_Setup_1024
Mode_800x600x8_1      = 53.8, 75.0,  800,  600,  8,  512,  800, 24836, QV08_800x600_1
Mode_800x600x8_1a     = 53.8, 75.0,  800,  600,  8,  512,  800, 24840, QV08_800x600_1,
   QV_Setup_1024
Mode_800x600x8_2      = 37.8, 60.0,  800,  600,  8,  512,  800, 24836, QV08_800x600_2
Mode_800x600x8_2a     = 37.8, 60.0,  800,  600,  8,  512,  800, 24840, QV08_800x600_2,
   QV_Setup_1024
Mode_800x600x8_3      = 53.8, 75.0,  800,  600,  8, 1024, 1024, 24836, QV08_800x600_3
Mode_800x600x8_3a     = 53.8, 75.0,  800,  600,  8, 1024, 1024, 24840, QV08_800x600_3,
   QV_Setup_1024
Mode_800x600x8_4      = 37.8, 60.0,  800,  600,  8, 1024, 1024, 24836, QV08_800x600_4
Mode_800x600x8_4a     = 37.8, 60.0,  800,  600,  8, 1024, 1024, 24840, QV08_800x600_4,
```

TOOLS D:\WINDOWS\CPQMODE.INI

3

```
  QV_Setup_1024
Mode_1024x768x8_1a      = 61.5, 76.0, 1024,  768,  8, 1024, 1024, 25096, QV08_1024x768_1
,  QV_Setup_1024
Mode_1024x768x8_2       = 57.0, 72.0, 1024,  768,  8, 1024, 1024, 24836, QV08_1024x768_2
Mode_1024x768x8_2a      = 57.0, 72.0, 1024,  768,  8, 1024, 1024, 24840, QV08_1024x768_2
,  QV_Setup_1024
Mode_1024x768x8_3       = 54.0, 66.0, 1024,  768,  8, 1024, 1024, 24836, QV08_1024x768_3
Mode_1024x768x8_3a      = 54.0, 66.0, 1024,  768,  8, 1024, 1024, 24840, QV08_1024x768_3
,  QV_Setup_1024
Mode_1024x768x8_4       = 48.0, 60.0, 1024,  768,  8, 1024, 1024, 24836, QV08_1024x768_4
Mode_1024x768x8_4a      = 48.0, 60.0, 1024,  768,  8, 1024, 1024, 24840, QV08_1024x768_4
,  QV_Setup_1024
Mode_1280x1024x8_1a     = 80.5, 76.0, 1280, 1024,  8, 2048, 2048, 25096, QV08_1280x1024_
1, QV_Setup_2048
Mode_1280x1024x8_2a     = 73.1, 68.0, 1280, 1024,  8, 2048, 2048, 25096, QV08_1280x1024_
2, QV_Setup_2048
Mode_1280x1024x8_3a     = 64.0, 60.0, 1280, 1024,  8, 2048, 2048, 25096, QV08_1280x1024_
3, QV_Setup_2048
Mode_640x480x15_1       = 31.5, 70.0,  640,  480, 15,  512, 1280, 24836, QV15_640x480_1
Mode_640x480x15_1a      = 31.5, 70.0,  640,  480, 15,  512, 1280, 24840, QV15_640x480_1,
   QV_Setup_1024
Mode_640x480x15_2       = 31.5, 60.0,  640,  480, 15,  512, 1280, 24836, QV15_640x480_2
Mode_640x480x15_2a      = 31.5, 60.0,  640,  480, 15,  512, 1280, 24840, QV15_640x480_2,
   QV_Setup_1024
Mode_640x480x15_3       = 45.0, 75.0,  640,  480, 15, 1024, 2048, 24836, QV15_640x480_3
Mode_640x480x15_3a      = 45.0, 75.0,  640,  480, 15, 1024, 2048, 24840, QV15_640x480_3,
   QV_Setup_1024
Mode_640x480x15_4       = 31.5, 60.0,  640,  480, 15, 1024, 2048, 24836, QV15_640x480_4
Mode_640x480x15_4a      = 31.5, 60.0,  640,  480, 15, 1024, 2048, 24840, QV15_640x480_4,
   QV_Setup_1024
Mode_800x600x15_1       = 53.8, 75.0,  800,  600, 15, 1024, 1600, 24836, QV15_800x600_1
Mode_800x600x15_1a      = 53.8, 75.0,  800,  600, 15, 1024, 1600, 24840, QV15_800x600_1,
   QV_Setup_1024
Mode_800x600x15_2       = 37.8, 60.0,  800,  600, 15, 1024, 1600, 24836, QV15_800x600_2
Mode_800x600x15_2a      = 37.8, 60.0,  800,  600, 15, 1024, 1600, 24840, QV15_800x600_2,
   QV_Setup_1024
Mode_800x600x15_3a      = 53.8, 75.0,  800,  600, 15, 2048, 2048, 24840, QV15_800x600_3,
   QV_Setup_1024
Mode_800x600x15_4a      = 37.8, 60.0,  800,  600, 15, 2048, 2048, 24840, QV15_800x600_4,
   QV_Setup_1024
Mode_1024x768x15_1a     = 57.0, 72.0, 1024,  768, 15, 2048, 2048, 24840, QV15_1024x768_1
,  QV_Setup_1024
Mode_1024x768x15_2a     = 54.0, 66.0, 1024,  768, 15, 2048, 2048, 24840, QV15_1024x768_2
,  QV_Setup_1024
Mode_1024x768x15_3a     = 48.0, 60.0, 1024,  768, 15, 2048, 2048, 24840, QV15_1024x768_3
,  QV_Setup_1024
Mode_640x480x16_1       = 31.5, 70.0,  640,  480, 16,  512, 1280, 24836, QV16_640x480_1
Mode_640x480x16_1a      = 31.5, 70.0,  640,  480, 16,  512, 1280, 24840, QV16_640x480_1,
   QV_Setup_1024
Mode_640x480x16_2       = 31.5, 60.0,  640,  480, 16,  512, 1280, 24836, QV16_640x480_2
Mode_640x480x16_2a      = 31.5, 60.0,  640,  480, 16,  512, 1280, 24840, QV16_640x480_2,
   QV_Setup_1024
Mode_640x480x16_3       = 45.0, 75.0,  640,  480, 16, 1024, 2048, 24836, QV16_640x480_3
Mode_640x480x16_3a      = 45.0, 75.0,  640,  480, 16, 1024, 2048, 24840, QV16_640x480_3,
   QV_Setup_1024
Mode_640x480x16_4       = 31.5, 60.0,  640,  480, 16, 1024, 2048, 24836, QV16_640x480_4
Mode_640x480x16_4a      = 31.5, 60.0,  640,  480, 16, 1024, 2048, 24840, QV16_640x480_4,
   QV_Setup_1024
Mode_800x600x16_1       = 53.8, 75.0,  800,  600, 16, 1024, 1600, 24836, QV16_800x600_1
Mode_800x600x16_1a      = 53.8, 75.0,  800,  600, 16, 1024, 1600, 24840, QV16_800x600_1,
```

4

```
  QV_Setup_1024
Mode_800x600x16_2       = 37.8, 60.0,  800,  600, 16, 1024, 1600, 24836, QV16_800x600_2
Mode_800x600x16_2a      = 37.8, 60.0,  800,  600, 16, 1024, 1600, 24840, QV16_800x600_2,
   QV_Setup_1024
Mode_800x600x16_3a      = 53.8, 75.0,  800,  600, 16, 2048, 2048, 24840, QV16_800x600_3,
   QV_Setup_1024
Mode_800x600x16_4a      = 37.8, 60.0,  800,  600, 16, 2048, 2048, 24840, QV16_800x600_4,
   QV_Setup_1024
Mode_1024x768x16_1a     = 57.0, 72.0, 1024,  768, 16, 2048, 2048, 24840, QV16_1024x768_1
,  QV_Setup_1024
Mode_1024x768x16_2a     = 54.0, 66.0, 1024,  768, 16, 2048, 2048, 24840, QV16_1024x768_2
,  QV_Setup_1024
Mode_1024x768x16_3a     = 48.0, 60.0, 1024,  768, 16, 2048, 2048, 24840, QV16_1024x768_3
,  QV_Setup_1024
Mode_640x400x32_1       = 31.5, 70.0,  640,  400, 32, 1024, 2560, 24836, QV32_640x400_1
Mode_640x400x32_1a      = 31.5, 70.0,  640,  400, 32, 1024, 2560, 24840, QV32_640x400_1,
   QV_Setup_1024
Mode_640x400x32_2       = 31.5, 60.0,  640,  400, 32, 1024, 2560, 24836, QV32_640x400_2
Mode_640x400x32_2a      = 31.5, 60.0,  640,  400, 32, 1024, 2560, 24840, QV32_640x400_2,
   QV_Setup_1024
Mode_640x400x32_3a      = 31.5, 70.0,  640,  400, 32, 2048, 4096, 24840, QV32_640x400_3,
   QV_Setup_1024
Mode_640x400x32_4a      = 31.5, 60.0,  640,  400, 32, 2048, 4096, 24840, QV32_640x400_4,
   QV_Setup_1024
Mode_640x480x32_1a      = 38.0, 72.0,  640,  480, 32, 2048, 4096, 24840, QV32_640x480_1,
   QV_Setup_1024
Mode_640x480x32_2a      = 31.5, 60.0,  640,  480, 32, 2048, 4096, 24840, QV32_640x480_2,
   QV_Setup_1024
;
;       IVGS     640x480x4 Mode Table   31.5 KHz, 60.0 Hz
;
[IV04_640x480]
Step01 = Table, Seq_Planar
Step02 = 08, 3C2h, E3h
Step03 = Table, CRTC_Unlock
Step04a= 08, 304h.00h, 5Fh, 4Fh, 50h, 82h, 54h \
Step04b=                80h, 0Bh, 3Eh, 00h, 40h \
Step04c=                00h, 00h, 00h, 00h, 00h \
Step04d=                00h, EAh, ACh, DFh, 28h \
Step04e=                00h, E7h, 04h, E3h, FFh
Step05 = Table, Attr_Ctrl_4
Step06 = Table, Graphics_Ctrl
;
;       AVGA     640x480x4 Mode Table   31.5 KHz, 60.0 Hz
;
[AV04_640x480]
Step01 = Table, Seq_Planar
Step02 = 08, 3C2h, E3h
Step03 = Table, CRTC_Unlock
Step04 = Table, AV_Dac
Step05a= 08, 304h.00h, 5Fh, 4Fh, 50h, 82h, 54h \
Step05b=                80h, 0Bh, 3Eh, 00h, 40h \
Step05c=                00h, 00h, 00h, 00h, 00h \
Step05d=                00h, EAh, ACh, DFh, 28h \
Step05e=                00h, E7h, 04h, E3h, FFh
Step06 = 08, 3CEh.42h, 00h
Step07 = Table, Attr_Ctrl_4
Step08 = Table, Graphics_Ctrl
;
;       AVGA     800x600x4 Mode Table   38.0 KHz, 60.0 Hz
```

5

```
;
[AV04_800x600]
Step01 = Table, Seq_Planar
Step02 = 0B, 3C2h, E8h
Step03 = Table, CRTC_Unlock
Step04 = Table, AV_Dac
Step05a= 0B, 3D4h.00h, 84h, 63h, 64h, 87h, 68h \
Step05b=               1Ch, 73h, F0h, 00h, 60h \
Step05c=               00h, 00h, 00h, 00h, 00h \
Step05d=               00h, 58h, 7Ch, 57h, 32h \
Step05e=               00h, 58h, 72h, E3h, FFh
Step06 = 0B, 3CEh.42h, 00h
Step07 = Table, Attr_Ctrl_4
Step08 = Table, Graphics_Ctrl
;
;       AVGA     640x480x8 Mode Table   31.5 KHz, 60.0 Hz
;
[AV08_640x480]
Step01 = Table, Seq_Packed
Step02 = 0B, 3C2h, E3h
Step03 = Table, Advanced_Setup
Step04 = Table, AV_Dac
Step05a= 0B, 3D4h.00h, C3h, 9Fh, A1h, 85h, A6h \
Step05b=               1Fh, 0Bh, 3Eh, 00h, 40h \
Step05c=               00h, 00h, 00h, 00h, 00h \
Step05d=               00h, EAh, ACh, DFh, 80h \
Step05e=               40h, E7h, 04h, E3h, FFh
Step06 = 0B, 3CEh.42h, 00h
Step07 = Table, Attr_Ctrl_8
Step08 = Table, Graphics_Ctrl
;
;       QVISION  640x480x4  Mode Table  45.0 KHz, 75.0 Hz
;
[QV04_640x480_1]
Step01 = Table, Seq_Packed
Step02 = Table, QV_Setup_4
Step03 = 0B, 3C2h, F3h
Step04 = Table, QV_Dac_4
Step05a= 0B, 3D4h.00h, 69h, 4Fh, 55h, 86h, 5Ch \
Step05b=               84h, 56h, B2h, 00h, 60h \
Step05c=               00h, 00h, 00h, 00h, 00h \
Step05d=               00h, 11h, A3h, DFh, 40h \
Step05e=               00h, 01h, 32h, E3h, FFh
Step06 = 0B, 3CEh.42h, 00h
Step07 = 0B, 3CEh.51h, 28h
Step08 = Table, QV_Cursor
Step09 = Table, Attr_Ctrl_8
Step10 = Table, Graphics_Ctrl
;
;       QVISION  640x480x4  Mode Table  31.5 KHz, 60.0 Hz
;
[QV04_640x480_2]
Step01 = Table, Seq_Packed
Step02 = Table, QV_Setup_4
Step03 = 0B, 3C2h, EFh
Step04 = Table, QV_Dac_4
Step05a= 0B, 3D4h.00h, 5Fh, 4Fh, 50h, 81h, 5Ah \
Step05b=               9Fh, 0Bh, 3Eh, 00h, 40h \
Step05c=               00h, 00h, 00h, 00h, 00h \
Step05d=               00h, EAh, ACh, DFh, 40h \
```

6

```
Step05e=               00h, E6h, 03h, E3h, FFh
Step06 = 0B, 3CEh.42h, 00h
Step07 = 0B, 3CEh.51h, 08h
Step08 = Table, QV_Cursor
Step09 = Table, Attr_Ctrl_8
Step10 = Table, Graphics_Ctrl
;
;       QVISION  800x600x4  Mode Table  53.8 KHz, 75.0 Hz
;
[QV04_800x600_1]
Step01 = Table, Seq_Packed
Step02 = Table, QV_Setup_4
Step03 = 0B, 3C2h, 23h
Step04 = Table, QV_Dac_4
Step05a= 0B, 3D4h.00h, 8Bh, 63h, 66h, 88h, 60h \
Step05b=               1Dh, C9h, F0h, 00h, 60h \
Step05c=               00h, 00h, 00h, 00h, 00h \
Step05d=               00h, 77h, BAh, 57h, 40h \
Step05e=               00h, 5Fh, C1h, E3h, FFh
Step06 = 0B, 3CEh.42h, 00h
Step07 = 0B, 3CEh.51h, 20h
Step08 = Table, QV_Cursor
Step09 = Table, Attr_Ctrl_8
Step10 = Table, Graphics_Ctrl
;
;       QVISION  800x600x4  Mode Table  37.8 KHz, 60.0 Hz
;
[QV04_800x600_2]
Step01 = Table, Seq_Packed
Step02 = Table, QV_Setup_4
Step03 = 0B, 3C2h, F3h
Step04 = Table, QV_Dac_4
Step05a= 0B, 3D4h.00h, 7Fh, 63h, 64h, 80h, 68h \
Step05b=               19h, 73h, F0h, 00h, 60h \
Step05c=               00h, 00h, 00h, 00h, 00h \
Step05d=               00h, 58h, 8Ch, 57h, 40h \
Step05e=               00h, 58h, 72h, E3h, FFh
Step06 = 0B, 3CEh.42h, 00h
Step07 = 0B, 3CEh.51h, 20h
Step08 = Table, QV_Cursor
Step09 = Table, Attr_Ctrl_8
Step10 = Table, Graphics_Ctrl
;
;       QVISION 1024x768x4  Mode Table 61.5 KHz, 76.0 Hz
;
[QV04_1024x768_1]
Step01 = Table, Seq_Packed
Step02 = Table, QV_Setup_4
Step03 = 0B, 3C2h, 33h
Step04 = Table, QV_Dac_4
Step05a= 0B, 3D4h.00h, 9Ch, 7Fh, 7Fh, 1Fh, 89h \
Step05b=               14h, 26h, F5h, 00h, 60h \
Step05c=               00h, 00h, 00h, 00h, 00h \
Step05d=               00h, 03h, BBh, FFh, 40h \
Step05e=               00h, FFh, 26h, E3h, FFh
Step06 = 0B, 3CEh.42h, 00h
Step07 = 0B, 3CEh.51h, 00h
Step08 = Table, QV_Cursor
Step09 = Table, Attr_Ctrl_8
Step10 = Table, Graphics_Ctrl
```

```
Step11 = Table, QV_DAC_Extended
;
;       QVISION 1024x768x4  Mode Table  57.0 KHz, 72.0 Hz
;
[QV04_1024x768_2]
Step01 = Table, Seq_Packed
Step02 = Table, QV_Setup_4
Step03 = 0B, 3C2h, 2Bh
Step04 = Table, QV_Dac_4
Step05a= 0B, 3D4h.00h, 9Eh, 7Fh, 7Fh, 81h, 86h \
Step05b=               96h, 1Eh, F1h, 00h, 60h \
Step05c=               00h, 00h, 00h, 00h, 00h \
Step05d=               00h, FFh, B3h, FFh, 40h \
Step05e=               00h, FFh, 1Eh, E3h, FFh
Step06 = 0B, 3CEh.42h, 00h
Step07 = 0B, 3CEh.51h, 00h
Step08 = Table, QV_Cursor
Step09 = Table, Attr_Ctrl_8
Step10 = Table, Graphics_Ctrl
;
;       QVISION 1024x768x4  Mode Table  54.0 KHz, 66.0 Hz
;
[QV04_1024x768_3]
Step01 = Table, Seq_Packed
Step02 = Table, QV_Setup_4
Step03 = 0B, 3C2h, 2Bh
Step04 = Table, QV_Dac_4
Step05a= 0B, 3D4h.00h, A9h, 7Fh, 7Fh, 0Ah, 87h \
Step05b=               9Fh, 2Eh, F5h, 00h, 60h \
Step05c=               00h, 00h, 00h, 00h, 00h \
Step05d=               00h, D6h, BAh, FFh, 40h \
Step05e=               00h, FFh, 2Ch, E3h, FFh
Step06 = 0B, 3CEh.42h, 00h
Step07 = 0B, 3CEh.51h, 00h
Step08 = Table, QV_Cursor
Step09 = Table, Attr_Ctrl_8
Step10 = Table, Graphics_Ctrl
;
;       QVISION 1024x768x4  Mode Table  48.0 KHz, 60.0 Hz
;
[QV04_1024x768_4]
Step01 = Table, Seq_Packed
Step02 = Table, QV_Setup_4
Step03 = 0B, 3C2h, E3h
Step04 = Table, QV_Dac_4
Step05a= 0B, 3D4h.00h, 9Bh, 7Fh, 7Fh, 9Eh, 87h \
Step05b=               17h, 31h, F5h, 00h, 60h \
Step05c=               00h, 00h, 00h, 00h, 00h \
Step05d=               00h, 0Dh, B4h, FFh, 40h \
Step05e=               00h, FFh, 31h, E3h, FFh
Step06 = 0B, 3CEh.42h, 00h
Step07 = 0B, 3CEh.51h, 00h
Step08 = Table, QV_Cursor
Step09 = Table, Attr_Ctrl_8
Step10 = Table, Graphics_Ctrl
;
;       QVISION 1280x1024x4  Mode Table 80.5 KHz, 76.0 Hz
;
[QV04_1280x1024_1]
Step01 = Table, Seq_Packed
```

```
Step02 = Table, QV_Setup_4
Step03 = 0B, 3C2h, 27h
Step04 = Table, QV_Dac_4
Step05a= 0B, 3D4h.00h, CAh, 9Fh, 9Fh, 8Dh, A9h \
Step05b=               1Dh, 24h, 5Ah, 00h, 60h \
Step05c=               00h, 00h, 00h, 00h, 00h \
Step05d=               00h, 01h, B5h, FFh, 80h \
Step05e=               00h, FFh, 24h, E3h, FFh
Step06 = 0B, 3CEh.42h, 00h
Step07 = 0B, 3CEh.51h, E8h
Step08 = Table, QV_Cursor
Step09 = Table, Attr_Ctrl_8
Step10 = Table, Graphics_Ctrl
Step11 = Table, QV_DAC_Extended
Step12 = Table, QV_DAC_External
;
;       QVISION 1280x1024x4  Mode Table 73.1 KHz, 68.0 Hz
;
[QV04_1280x1024_2]
Step01 = Table, Seq_Packed
Step02 = Table, QV_Setup_4
Step03 = 0B, 3C2h, 23h
Step04 = Table, QV_Dac_4
Step05a= 0B, 3D4h.00h, CFh, 9Fh, 9Fh, 12h, A4h \
Step05b=               19h, 2Eh, 5Ah, 00h, 60h \
Step05c=               00h, 00h, 00h, 00h, 00h \
Step05d=               00h, 03h, BBh, FFh, 80h \
Step05e=               00h, FFh, 2Eh, E3h, FFh
Step06 = 0B, 3CEh.42h, 00h
Step07 = 0B, 3CEh.51h, E8h
Step08 = Table, QV_Cursor
Step09 = Table, Attr_Ctrl_8
Step10 = Table, Graphics_Ctrl
Step11 = Table, QV_DAC_Extended
;
;       QVISION 1280x1024x4  Mode Table 64.0 KHz, 60.0 Hz
;
[QV04_1280x1024_3]
Step01 = Table, Seq_Packed
Step02 = Table, QV_Setup_4
Step03 = 0B, 3C2h, 23h
Step04 = Table, QV_Dac_4
Step05a= 0B, 3D4h.00h, EDh, 9Fh, 9Fh, 10h, AEh \
Step05b=               90h, 2Ah, 5Ah, 00h, 60h \
Step05c=               00h, 00h, 00h, 00h, 00h \
Step05d=               00h, 03h, B7h, FFh, 80h \
Step05e=               00h, FFh, 2Ah, E3h, FFh
Step06 = 0B, 3CEh.42h, 00h
Step07 = 0B, 3CEh.51h, C8h
Step08 = Table, QV_Cursor
Step09 = Table, Attr_Ctrl_8
Step10 = Table, Graphics_Ctrl
Step11 = Table, QV_DAC_Extended
;
;       QVISION  640x480x8  Mode Table  45.0 KHz, 75.0 Hz
;
[QV08_640x480_1]
Step01 = Table, Seq_Packed
Step02 = Table, QV_Setup_8
Step03 = 0B, 3C2h, F3h
```

```
Step04 = Table, QV_Dac_8
Step05a= 0B, 3D4h.00h, 69h, 4Fh, 55h, 86h, 59h \
Step05b=               81h, 56h, B2h, 00h, 60h \
Step05c=               00h, 00h, 00h, 00h, 00h \
Step05d=               00h, 11h, A3h, DFh, 80h \
Step05e=               00h, 01h, 32h, E3h, FFh
Step06 = 0B, 3CEh.42h, 00h
Step07 = 0B, 3CEh.51h, 28h
Step08 = Table, QV_Cursor
Step09 = Table, Attr_Ctrl_8
Step10 = Table, Graphics_Ctrl
;
;       QVISION  640x480x8  Mode Table  31.5 KHz, 60.0 Hz
;
[QV08_640x480_2]
Step01 = Table, Seq_Packed
Step02 = Table, QV_Setup_8
Step03 = 0B, 3C2h, EFh
Step04 = Table, QV_Dac_8
Step05a= 0B, 3D4h.00h, 5Fh, 4Fh, 50h, 81h, 53h \
Step05b=               9Fh, 0Bh, 3Eh, 00h, 40h \
Step05c=               00h, 00h, 00h, 00h, 00h \
Step05d=               00h, EAh, ACh, DFh, 80h \
Step05e=               00h, E5h, 03h, E3h, FFh
Step06 = 0B, 3CEh.42h, 00h
Step07 = 0B, 3CEh.51h, 08h
Step08 = Table, QV_Cursor
Step09 = Table, Attr_Ctrl_8
Step10 = Table, Graphics_Ctrl
;
;       QVISION  800x600x8  Mode Table  53.8 KHz, 75.0 Hz
;
[QV08_800x600_1]
Step01 = Table, Seq_Packed
Step02 = Table, QV_Setup_8
Step03 = 0B, 3C2h, 23h
Step04 = Table, QV_Dac_8
Step05a= 0B, 3D4h.00h, 8Bh, 63h, 66h, 88h, 6Dh \
Step05b=               10h, C9h, F0h, 00h, 60h \
Step05c=               00h, 00h, 00h, 00h, 00h \
Step05d=               00h, 77h, BAh, 57h, 64h \
Step05e=               00h, 5Fh, C1h, E3h, FFh
Step06 = 0B, 3CEh.42h, 00h
Step07 = 0B, 3CEh.51h, 20h
Step08 = Table, QV_Cursor
Step09 = Table, Attr_Ctrl_8
Step10 = Table, Graphics_Ctrl
;
;       QVISION  800x600x8  Mode Table  37.8 KHz, 60.0 Hz
;
[QV08_800x600_2]
Step01 = Table, Seq_Packed
Step02 = Table, QV_Setup_8
Step03 = 0B, 3C2h, F3h
Step04 = Table, QV_Dac_8
Step05a= 0B, 3D4h.00h, 7Fh, 63h, 64h, 80h, 68h \
Step05b=               19h, 73h, F0h, 00h, 60h \
Step05c=               00h, 00h, 00h, 00h, 00h \
Step05d=               00h, 58h, BCh, 57h, 64h \
Step05e=               00h, 58h, 72h, E3h, FFh
```

```
Step06 = 0B, 3CEh.42h, 00h
Step07 = 0B, 3CEh.51h, 20h
Step08 = Table, QV_Cursor
Step09 = Table, Attr_Ctrl_8
Step10 = Table, Graphics_Ctrl
;
;       QVISION  800x600x8  Mode Table  53.8 KHz, 75.0 Hz
;
[QV08_800x600_3]
Step01 = Table, Seq_Packed
Step02 = Table, QV_Setup_8
Step03 = 0B, 3C2h, 23h
Step04 = Table, QV_Dac_8
Step05a= 0B, 3D4h.00h, 8Bh, 63h, 66h, 88h, 6Dh \
Step05b=               10h, C9h, F0h, 00h, 60h \
Step05c=               00h, 00h, 00h, 00h, 00h \
Step05d=               00h, 77h, BAh, 57h, 80h \
Step05e=               00h, 5Fh, C1h, E3h, FFh
Step06 = 0B, 3CEh.42h, 00h
Step07 = 0B, 3CEh.51h, 20h
Step08 = Table, QV_Cursor
Step09 = Table, Attr_Ctrl_8
Step10 = Table, Graphics_Ctrl
;
;       QVISION  800x600x8  Mode Table  37.8 KHz, 60.0 Hz
;
[QV08_800x600_4]
Step01 = Table, Seq_Packed
Step02 = Table, QV_Setup_8
Step03 = 0B, 3C2h, F3h
Step04 = Table, QV_Dac_8
Step05a= 0B, 3D4h.00h, 7Fh, 63h, 64h, 80h, 68h \
Step05b=               19h, 73h, F0h, 00h, 60h \
Step05c=               00h, 00h, 00h, 00h, 00h \
Step05d=               00h, 58h, BCh, 57h, 80h \
Step05e=               00h, 58h, 72h, E3h, FFh
Step06 = 0B, 3CEh.42h, 00h
Step07 = 0B, 3CEh.51h, 20h
Step08 = Table, QV_Cursor
Step09 = Table, Attr_Ctrl_8
Step10 = Table, Graphics_Ctrl
;
;       QVISION 1024x768x8  Mode Table 61.5 KHz, 76.0 Hz
;
[QV08_1024x768_1]
Step01 = Table, Seq_Packed
Step02 = Table, QV_Setup_8
Step03 = 0B, 3C2h, 33h
Step04 = Table, QV_Dac_8
Step05a= 0B, 3D4h.00h, 9Ch, 7Fh, 7Fh, 1Fh, 86h \
Step05b=               11h, 26h, F5h, 00h, 60h \
Step05c=               00h, 00h, 00h, 00h, 00h \
Step05d=               00h, 03h, 8Bh, FFh, 80h \
Step05e=               00h, FFh, 26h, E3h, FFh
Step06 = 0B, 3CEh.42h, 00h
Step07 = 0B, 3CEh.51h, 00h
Step08 = Table, QV_Cursor
Step09 = Table, Attr_Ctrl_8
Step10 = Table, Graphics_Ctrl
Step11 = Table, QV_DAC_Extended
```

11

```
;
;       QVISION 1024x768x8  Mode Table  57.0 KHz, 72.0 Hz
;
[QV08_1024x768_2]
Step01 = Table, Seq_Packed
Step02 = Table, QV_Setup_8
Step03 = 0B, 3C2h, 28h
Step04 = Table, QV_Dac_8
Step05a= 0B, 3D4h.00h, 9Eh, 7Fh, 7Fh, 81h, 83h \
Step05b=               93h, 1Eh, F1h, 00h, 60h \
Step05c=               00h, 00h, 00h, 00h, 00h \
Step05d=               00h, FFh, B3h, FFh, 80h \
Step05e=               00h, FFh, 1Eh, E3h, FFh
Step06 = 0B, 3CEh.42h, 00h
Step07 = 0B, 3CEh.51h, 00h
Step08 = Table, QV_Cursor
Step09 = Table, Attr_Ctrl_8
Step10 = Table, Graphics_Ctrl
;
;       QVISION 1024x768x8  Mode Table  54.0 KHz, 66.0 Hz
;
[QV08_1024x768_3]
Step01 = Table, Seq_Packed
Step02 = Table, QV_Setup_8
Step03 = 0B, 3C2h, 28h
Step04 = Table, QV_Dac_8
Step05a= 0B, 3D4h.00h, A9h, 7Fh, 7Fh, 0Ah, 87h \
Step05b=               9Fh, 2Eh, F5h, 00h, 60h \
Step05c=               00h, 00h, 00h, 00h, 00h \
Step05d=               00h, 06h, BAh, FFh, 80h \
Step05e=               00h, FFh, 2Ch, E3h, FFh
Step06 = 0B, 3CEh.42h, 00h
Step07 = 0B, 3CEh.51h, 00h
Step08 = Table, QV_Cursor
Step09 = Table, Attr_Ctrl_8
Step10 = Table, Graphics_Ctrl
;
;       QVISION 1024x768x8  Mode Table  48.0 KHz, 60.0 Hz
;
[QV08_1024x768_4]
Step01 = Table, Seq_Packed
Step02 = Table, QV_Setup_8
Step03 = 0B, 3C2h, E3h
Step04 = Table, QV_Dac_8
Step05a= 0B, 3D4h.00h, 9Bh, 7Fh, 7Fh, 9Eh, 87h \
Step05b=               17h, 31h, F5h, 00h, 60h \
Step05c=               00h, 00h, 00h, 00h, 00h \
Step05d=               00h, 00h, B4h, FFh, 80h \
Step05e=               00h, FFh, 31h, E3h, FFh
Step06 = 0B, 3CEh.42h, 00h
Step07 = 0B, 3CEh.51h, 00h
Step08 = Table, QV_Cursor
Step09 = Table, Attr_Ctrl_8
Step10 = Table, Graphics_Ctrl
;
;       QVISION 1280x1024x8  Mode Table 80.5 KHz, 76.0 Hz
;
[QV08_1280x1024_1]
Step01 = Table, Seq_Packed
Step02 = Table, QV_Setup_8
```

12

```
Step03 = 0B, 3C2h, 27h
Step04 = Table, QV_Dac_8
Step05a= 0B, 3D4h.00h, CAh, 9Fh, 9Fh, 8Dh, A6h \
Step05b=               1Ah, 24h, 5Ah, 00h, 60h \
Step05c=               00h, 00h, 00h, 00h, 00h \
Step05d=               00h, 01h, B5h, FFh, 00h \
Step05e=               00h, FFh, 24h, E3h, FFh
Step06 = 0B, 3CEh.42h, 01h
Step07 = 0B, 3CEh.51h, E8h
Step08 = Table, QV_Cursor
Step09 = Table, Attr_Ctrl_8
Step10 = Table, Graphics_Ctrl
Step11 = Table, QV_DAC_Extended
Step12 = Table, QV_DAC_External
;
;       QVISION 1280x1024x8  Mode Table 73.1 KHz, 68.0 Hz
;
[QV08_1280x1024_2]
Step01 = Table, Seq_Packed
Step02 = Table, QV_Setup_8
Step03 = 0B, 3C2h, 23h
Step04 = Table, QV_Dac_8
Step05a= 0B, 3D4h.00h, CFh, 9Fh, 9Fh, 12h, A4h \
Step05b=               19h, 2Eh, 5Ah, 00h, 60h \
Step05c=               00h, 00h, 00h, 00h, 00h \
Step05d=               00h, 03h, BBh, FFh, 00h \
Step05e=               00h, FFh, 2Eh, E3h, FFh
Step06 = 0B, 3CEh.42h, 01h
Step07 = 0B, 3CEh.51h, E8h
Step08 = Table, QV_Cursor
Step09 = Table, Attr_Ctrl_8
Step10 = Table, Graphics_Ctrl
Step11 = Table, QV_DAC_Extended
;
;       QVISION 1280x1024x8  Mode Table 64.0 KHz, 60.0 Hz
;
[QV08_1280x1024_3]
Step01 = Table, Seq_Packed
Step02 = Table, QV_Setup_8
Step03 = 0B, 3C2h, 23h
Step04 = Table, QV_Dac_8
Step05a= 0B, 3D4h.00h, EDh, 9Fh, 9Fh, 10h, AEh \
Step05b=               90h, 2Ah, 5Ah, 00h, 60h \
Step05c=               00h, 00h, 00h, 00h, 00h \
Step05d=               00h, 03h, B7h, FFh, 00h \
Step05e=               00h, FFh, 2Ah, E3h, FFh
Step06 = 0B, 3CEh.42h, 01h
Step07 = 0B, 3CEh.51h, C8h
Step08 = Table, QV_Cursor
Step09 = Table, Attr_Ctrl_8
Step10 = Table, Graphics_Ctrl
Step11 = Table, QV_DAC_Extended


;
;       QVISION  640x480x15 Mode Table  45.0 KHz, 75.0 Hz
;
[QV15_640x480_1]
Step01 = Table, Seq_Packed
Step02 = Table, QV_Setup_16
```

13

```
Step03 = 0B, 3C2h, F3h
Step04 = Table, QV_Dac_15
Step05a= 0B, 3D4h.00h, 69h, 4Fh, 55h, 86h, 58h \
Step05b=               80h, 56h, B2h, 00h, 60h \
Step05c=               00h, 00h, 00h, 00h, 00h \
Step05d=               00h, 11h, A3h, DFh, A0h \
Step05e=               00h, 01h, 32h, E3h, FFh
Step06 = 0B, 3CEh.42h, 00h
Step07 = 0B, 3CEh.51h, 28h
Step08 = Table, QV_Cursor
Step09 = Table, Attr_Ctrl_8
Step10 = Table, Graphics_Ctrl
;
;       QVISION  640x480x15 Mode Table  31.5 KHz, 60.0 Hz
;
[QV15_640x480_2]
Step01 = Table, Seq_Packed
Step02 = Table, QV_Setup_16
Step03 = 0B, 3C2h, EFh
Step04 = Table, QV_Dac_15
Step05a= 0B, 3D4h.00h, 5Fh, 4Fh, 50h, 81h, 53h \
Step05b=               9Fh, 0Bh, 3Eh, 00h, 40h \
Step05c=               00h, 00h, 00h, 00h, 00h \
Step05d=               00h, EAh, ACh, DFh, A0h \
Step05e=               00h, E5h, 03h, E3h, FFh
Step06 = 0B, 3CEh.42h, 00h
Step07 = 0B, 3CEh.51h, 08h
Step08 = Table, QV_Cursor
Step09 = Table, Attr_Ctrl_8
Step10 = Table, Graphics_Ctrl
;
;       QVISION  640x480x15 Mode Table  45.0 KHz, 75.0 Hz
;
[QV15_640x480_3]
Step01 = Table, Seq_Packed
Step02 = Table, QV_Setup_16
Step03 = 0B, 3C2h, F3h
Step04 = Table, QV_Dac_15
Step05a= 0B, 3D4h.00h, 69h, 4Fh, 55h, 86h, 58h \
Step05b=               80h, 56h, B2h, 00h, 60h \
Step05c=               00h, 00h, 00h, 00h, 00h \
Step05d=               00h, 11h, A3h, DFh, 00h \
Step05e=               00h, 01h, 32h, E3h, FFh
Step06 = 0B, 3CEh.42h, 01h
Step07 = 0B, 3CEh.51h, 28h
Step08 = Table, QV_Cursor
Step09 = Table, Attr_Ctrl_8
Step10 = Table, Graphics_Ctrl
;
;       QVISION  640x480x15 Mode Table  31.5 KHz, 60.0 Hz
;
[QV15_640x480_4]
Step01 = Table, Seq_Packed
Step02 = Table, QV_Setup_16
Step03 = 0B, 3C2h, EFh
Step04 = Table, QV_Dac_15
Step05a= 0B, 3D4h.00h, 5Fh, 4Fh, 50h, 81h, 53h \
Step05b=               9Fh, 0Bh, 3Eh, 00h, 40h \
Step05c=               00h, 00h, 00h, 00h, 00h \
Step05d=               00h, EAh, ACh, DFh, 00h \
```

14

```
Step05e=               00h, E5h, 03h, E3h, FFh
Step06 = 0B, 3CEh.42h, 01h
Step07 = 0B, 3CEh.51h, 08h
Step08 = Table, QV_Cursor
Step09 = Table, Attr_Ctrl_8
Step10 = Table, Graphics_Ctrl
;
;       QVISION  800x600x15 Mode Table  53.8 KHz, 75.0 Hz
;
[QV15_800x600_1]
Step01 = Table, Seq_Packed
Step02 = Table, QV_Setup_16
Step03 = 0B, 3C2h, 23h
Step04 = Table, QV_Dac_15
Step05a= 0B, 3D4h.00h, 8Bh, 63h, 66h, 8Bh, 6Ch \
Step05b=               1Ch, C9h, F0h, 00h, 60h \
Step05c=               00h, 00h, 00h, 00h, 00h \
Step05d=               00h, 77h, BAh, 57h, C8h \
Step05e=               00h, 5Fh, C1h, E3h, FFh
Step06 = 0B, 3CEh.42h, 00h
Step07 = 0B, 3CEh.51h, 20h
Step08 = Table, QV_Cursor
Step09 = Table, Attr_Ctrl_8
Step10 = Table, Graphics_Ctrl
;
;       QVISION  800x600x15 Mode Table  37.8 KHz, 60.0 Hz
;
[QV15_800x600_2]
Step01 = Table, Seq_Packed
Step02 = Table, QV_Setup_16
Step03 = 0B, 3C2h, F3h
Step04 = Table, QV_Dac_15
Step05a= 0B, 3D4h.00h, 7Fh, 63h, 64h, 80h, 68h \
Step05b=               19h, 73h, F0h, 00h, 60h \
Step05c=               00h, 00h, 00h, 00h, 00h \
Step05d=               00h, 58h, 8Ch, 57h, C8h \
Step05e=               00h, 58h, 72h, E3h, FFh
Step06 = 0B, 3CEh.42h, 00h
Step07 = 0B, 3CEh.51h, 20h
Step08 = Table, QV_Cursor
Step09 = Table, Attr_Ctrl_8
Step10 = Table, Graphics_Ctrl
;
;       QVISION  800x600x15 Mode Table  53.8 KHz, 75.0 Hz
;
[QV15_800x600_3]
Step01 = Table, Seq_Packed
Step02 = Table, QV_Setup_16
Step03 = 0B, 3C2h, 23h
Step04 = Table, QV_Dac_15
Step05a= 0B, 3D4h.00h, 8Bh, 63h, 66h, 8Bh, 6Ch \
Step05b=               1Ch, C9h, F0h, 00h, 60h \
Step05c=               00h, 00h, 00h, 00h, 00h \
Step05d=               00h, 77h, BAh, 57h, 00h \
Step05e=               00h, 5Fh, C1h, E3h, FFh
Step06 = 0B, 3CEh.42h, 01h
Step07 = 0B, 3CEh.51h, 20h
Step08 = Table, QV_Cursor
Step09 = Table, Attr_Ctrl_8
Step10 = Table, Graphics_Ctrl
```

15

```
;
;       QVISION  800x600x15 Mode Table  37.8 KHz, 60.0 Hz
;
[QV15_800x600_4]
Step01 = Table, Seq_Packed
Step02 = Table, QV_Setup_16
Step03 = 0B, 3C2h, F3h
Step04 = Table, QV_Dac_15
Step05a= 0B, 3D4h.00h, 7Fh, 63h, 64h, 80h, 68h \
Step05b=               19h, 73h, F0h, 00h, 60h \
Step05c=               00h, 00h, 00h, 00h, 00h \
Step05d=               00h, 58h, BCh, 57h, 00h \
Step05e=               00h, 58h, 72h, E3h, FFh
Step06 = 0B, 3CEh.42h, 01h
Step07 = 0B, 3CEh.51h, 20h
Step08 = Table, QV_Cursor
Step09 = Table, Attr_Ctrl_8
Step10 = Table, Graphics_Ctrl
;
;       QVISION 1024x768x15 Mode Table  57.0 KHz, 72.0 Hz
;
[QV15_1024x768_1]
Step01 = Table, Seq_Packed
Step02 = Table, QV_Setup_16
Step03 = 0B, 3C2h, 28h
Step04 = Table, QV_Dac_15
Step05a= 0B, 3D4h.00h, 9Eh, 7Fh, 7Fh, 81h, 82h \
Step05b=               92h, 1Eh, F1h, 00h, 60h \
Step05c=               00h, 00h, 00h, 00h, 00h \
Step05d=               00h, FFh, A3h, FFh, 00h \
Step05e=               00h, FFh, 1Eh, E3h, FFh
Step06 = 0B, 3CEh.42h, 01h
Step07 = 0B, 3CEh.51h, 00h
Step08 = Table, QV_Cursor
Step09 = Table, Attr_Ctrl_8
Step10 = Table, Graphics_Ctrl
;
;       QVISION 1024x768x15 Mode Table  54.0 KHz, 66.0 Hz
;
[QV15_1024x768_2]
Step01 = Table, Seq_Packed
Step02 = Table, QV_Setup_16
Step03 = 0B, 3C2h, 28h
Step04 = Table, QV_Dac_15
Step05a= 0B, 3D4h.00h, A9h, 7Fh, 7Fh, 0Ah, 87h \
Step05b=               9Fh, 2Eh, F5h, 00h, 60h \
Step05c=               00h, 00h, 00h, 00h, 00h \
Step05d=               00h, 06h, AAh, FFh, 00h \
Step05e=               00h, FFh, 2Ch, E3h, FFh
Step06 = 0B, 3CEh.42h, 01h
Step07 = 0B, 3CEh.51h, 00h
Step08 = Table, QV_Cursor
Step09 = Table, Attr_Ctrl_8
Step10 = Table, Graphics_Ctrl
;
;       QVISION 1024x768x15 Mode Table  48.0 KHz, 60.0 Hz
;
[QV15_1024x768_3]
Step01 = Table, Seq_Packed
Step02 = Table, QV_Setup_16
```

16

```
Step03 = 0B, 3C2h, E3h
Step04 = Table, QV_Dac_15
Step05a= 0B, 3D4h.00h, 98h, 7Fh, 7Fh, 9Eh, 87h \
Step05b=               17h, 31h, F5h, 00h, 60h \
Step05c=               00h, 00h, 00h, 00h, 00h \
Step05d=               00h, 00h, B4h, FFh, 00h \
Step05e=               00h, FFh, 31h, E3h, FFh
Step06 = 0B, 3CEh.42h, 01h
Step07 = 0B, 3CEh.51h, 00h
Step08 = Table, QV_Cursor
Step09 = Table, Attr_Ctrl_8
Step10 = Table, Graphics_Ctrl
;
;       QVISION  640x480x16 Mode Table  45.0 KHz, 75.0 Hz
;
[QV16_640x480_1]
Step01 = Table, Seq_Packed
Step02 = Table, QV_Setup_16
Step03 = 0B, 3C2h, F3h
Step04 = Table, QV_Dac_16
Step05a= 0B, 3D4h.00h, 69h, 4Fh, 55h, 86h, 58h \
Step05b=               80h, 56h, B2h, 00h, 60h \
Step05c=               00h, 00h, 00h, 00h, 00h \
Step05d=               00h, 11h, A3h, DFh, A0h \
Step05e=               00h, E5h, 03h, E3h, FFh
Step06 = 0B, 3CEh.42h, 00h
Step07 = 0B, 3CEh.51h, 28h
Step08 = Table, QV_Cursor
Step09 = Table, Attr_Ctrl_8
Step10 = Table, Graphics_Ctrl
;
;       QVISION  640x480x16 Mode Table  31.5 KHz, 60.0 Hz
;
[QV16_640x480_2]
Step01 = Table, Seq_Packed
Step02 = Table, QV_Setup_16
Step03 = 0B, 3C2h, EFh
Step04 = Table, QV_Dac_16
Step05a= 0B, 3D4h.00h, 5Fh, 4Fh, 50h, 81h, 53h \
Step05b=               9Fh, 0Bh, 3Eh, 00h, 40h \
Step05c=               00h, 00h, 00h, 00h, 00h \
Step05d=               00h, EAh, ACh, DFh, A0h \
Step05e=               00h, E5h, 03h, E3h, FFh
Step06 = 0B, 3CEh.42h, 00h
Step07 = 0B, 3CEh.51h, 08h
Step08 = Table, QV_Cursor
Step09 = Table, Attr_Ctrl_8
Step10 = Table, Graphics_Ctrl
;
;       QVISION  640x480x16 Mode Table  45.0 KHz, 75.0 Hz
;
[QV16_640x480_3]
Step01 = Table, Seq_Packed
Step02 = Table, QV_Setup_16
Step03 = 0B, 3C2h, F3h
Step04 = Table, QV_Dac_16
Step05a= 0B, 3D4h.00h, 69h, 4Fh, 55h, 86h, 58h \
Step05b=               80h, 56h, B2h, 00h, 60h \
Step05c=               00h, 00h, 00h, 00h, 00h \
Step05d=               00h, 11h, A3h, DFh, 00h \
```

17

```
Step05e=                00h, E5h, 03h, E3h, FFh
Step06 = 0B, 3CEh.42h, 01h
Step07 = 0B, 3CEh.51h, 28h
Step08 = Table, QV_Cursor
Step09 = Table, Attr_Ctrl_8
Step10 = Table, Graphics_Ctrl
;
;       QVISION  640x480x16 Mode Table  31.5 KHz, 60.0 Hz
;
[QV16_640x480_4]
Step01 = Table, Seq_Packed
Step02 = Table, QV_Setup_16
Step03 = 0B, 3C2h, EFh
Step04 = Table, QV_Dac_16
Step05a= 0B, 3D4h.00h, 5Fh, 4Fh, 50h, 81h, 53h \
Step05b=                9Fh, 0Bh, 3Eh, 00h, 40h \
Step05c=                00h, 00h, 00h, 00h, 00h \
Step05d=                00h, EAh, ACh, DFh, 00h \
Step05e=                00h, E5h, 03h, E3h, FFh
Step06 = 0B, 3CEh.42h, 01h
Step07 = 0B, 3CEh.51h, 08h
Step08 = Table, QV_Cursor
Step09 = Table, Attr_Ctrl_8
Step10 = Table, Graphics_Ctrl
;
;       QVISION  800x600x16 Mode Table .53.8 KHz, 75.0 Hz
;
[QV16_800x600_1]
Step01 = Table, Seq_Packed
Step02 = Table, QV_Setup_16
Step03 = 0B, 3C2h, 23h
Step04 = Table, QV_Dac_16
Step05a= 0B, 3D4h.00h, 8Bh, 63h, 66h, 8Bh, 6Ch \
Step05b=                1Ch, C9h, F0h, 00h, 60h \
Step05c=                00h, 00h, 00h, 00h, 00h \
Step05d=                00h, 77h, BAh, 57h, C8h \
Step05e=                00h, 5Fh, C1h, E3h, FFh
Step06 = 0B, 3CEh.42h, 00h
Step07 = 0B, 3CEh.51h, 20h
Step08 = Table, QV_Cursor
Step09 = Table, Attr_Ctrl_8
Step10 = Table, Graphics_Ctrl
;
;       QVISION  800x600x16 Mode Table  37.8 KHz, 60.0 Hz
;
[QV16_800x600_2]
Step01 = Table, Seq_Packed
Step02 = Table, QV_Setup_16
Step03 = 0B, 3C2h, F3h
Step04 = Table, QV_Dac_16
Step05a= 0B, 3D4h.00h, 7Fh, 63h, 64h, 80h, 68h \
Step05b=                19h, 73h, F0h, 00h, 60h \
Step05c=                00h, 00h, 00h, 00h, 00h \
Step05d=                00h, 58h, BCh, 57h, C8h \
Step05e=                00h, 58h, 72h, E3h, FFh
Step06 = 0B, 3CEh.42h, 00h
Step07 = 0B, 3CEh.51h, 20h
Step08 = Table, QV_Cursor
Step09 = Table, Attr_Ctrl_8
Step10 = Table, Graphics_Ctrl
```

18

```
;
;       QVISION  800x600x16 Mode Table  53.8 KHz, 75.0 Hz
;
[QV16_800x600_3]
Step01 = Table, Seq_Packed
Step02 = Table, QV_Setup_16
Step03 = 0B, 3C2h, 23h
Step04 = Table, QV_Dac_16
Step05a= 0B, 3D4h.00h, 8Bh, 63h, 66h, 8Bh, 6Ch \
Step05b=                1Ch, C9h, F0h, 00h, 60h \
Step05c=                00h, 00h, 00h, 00h, 00h \
Step05d=                00h, 77h, BAh, 57h, 00h \
Step05e=                00h, 5Fh, C1h, E3h, FFh
Step06 = 0B, 3CEh.42h, 01h
Step07 = 0B, 3CEh.51h, 20h
Step08 = Table, QV_Cursor
Step09 = Table, Attr_Ctrl_8
Step10 = Table, Graphics_Ctrl
;
;       QVISION  800x600x16 Mode Table  37.8 KHz, 60.0 Hz
;
[QV16_800x600_4]
Step01 = Table, Seq_Packed
Step02 = Table, QV_Setup_16
Step03 = 0B, 3C2h, F3h
Step04 = Table, QV_Dac_16
Step05a= 0B, 3D4h.00h, 7Fh, 63h, 64h, 80h, 68h \
Step05b=                19h, 73h, F0h, 00h, 60h \
Step05c=                00h, 00h, 00h, 00h, 00h \
Step05d=                00h, 58h, BCh, 57h, 00h \
Step05e=                00h, 58h, 72h, E3h, FFh
Step06 = 0B, 3CEh.42h, 01h
Step07 = 0B, 3CEh.51h, 20h
Step08 = Table, QV_Cursor
Step09 = Table, Attr_Ctrl_8
Step10 = Table, Graphics_Ctrl
;
;       QVISION 1024x768x16 Mode Table  57.0 KHz, 72.0 Hz
;
[QV16_1024x768_1]
Step01 = Table, Seq_Packed
Step02 = Table, QV_Setup_16
Step03 = 0B, 3C2h, 2Bh
Step04 = Table, QV_Dac_15
Step05a= 0B, 3D4h.00h, 9Eh, 7Fh, 7Fh, 81h, 82h \
Step05b=                92h, 1Eh, F1h, 00h, 60h \
Step05c=                00h, 00h, 00h, 00h, 00h \
Step05d=                00h, FFh, B3h, FFh, 00h \
Step05e=                00h, FFh, 1Eh, E3h, FFh
Step06 = 0B, 3CEh.42h, 01h
Step07 = 0B, 3CEh.51h, 00h
Step08 = Table, QV_Cursor
Step09 = Table, Attr_Ctrl_8
Step10 = Table, Graphics_Ctrl
;
;       QVISION 1024x768x16 Mode Table  54.0 KHz, 66.0 Hz
;
[QV16_1024x768_2]
Step01 = Table, Seq_Packed
Step02 = Table, QV_Setup_16
```

19

```
Step03 = 0B, 3C2h, 28h
Step04 = Table, QV_Dac_15
Step05a= 0B, 3D4h.00h, A9h, 7Fh, 7Fh, 0Ah, 87h \
Step05b=               9Fh, 2Eh, F5h, 00h, 60h \
Step05c=               00h, 00h, 00h, 00h, 00h \
Step05d=               00h, 06h, BAh, FFh, 00h \
Step05e=               00h, FFh, 2Ch, E3h, FFh
Step06 = 0B, 3CEh.42h, 01h
Step07 = 0B, 3CEh.51h, 00h
Step08 = Table, QV_Cursor
Step09 = Table, Attr_Ctrl_8
Step10 = Table, Graphics_Ctrl
;
;       QVISION 1024x768x16 Mode Table  48.0 KHz, 60.0 Hz
;
[QV16_1024x768_3]
Step01 = Table, Seq_Packed
Step02 = Table, QV_Setup_16
Step03 = 0B, 3C2h, E3h
Step04 = Table, QV_Dac_15
Step05a= 0B, 3D4h.00h, 96h, 7Fh, 7Fh, 9Eh, 87h \
Step05b=               17h, 31h, F5h, 00h, 60h \
Step05c=               00h, 00h, 00h, 00h, 00h \
Step05d=               00h, 00h, B4h, FFh, 00h \
Step05e=               00h, FFh, 31h, E3h, FFh
Step06 = 0B, 3CEh.42h, 01h
Step07 = 0B, 3CEh.51h, 00h
Step08 = Table, QV_Cursor
Step09 = Table, Attr_Ctrl_8
Step10 = Table, Graphics_Ctrl
;
;       QVISION  640x400x32 Mode Table  31.5 KHz, 70.0 Hz
;
[QV32_640x400_1]
Step01 = Table, Seq_Packed
Step02 = Table, QV_Setup_32
Step03 = 0B, 3C2h, 6Fh
Step04 = Table, QV_Dac_32
Step05a= 0B, 3D4h.00h, 5Fh, 4Fh, 50h, 82h, 54h \
Step05b=               80h, BFh, 1Fh, 00h, 40h \
Step05c=               00h, 00h, 00h, 00h, 00h \
Step05d=               00h, 9Ch, AEh, 8Fh, 40h \
Step05e=               00h, 96h, B9h, E3h, FFh
Step06 = 0B, 3CEh.42h, 01h
Step07 = 0B, 3CEh.51h, 28h
Step08 = Table, QV_Cursor
Step09 = Table, Attr_Ctrl_8
Step10 = Table, Graphics_Ctrl
;
;       QVISION  640x400x32 Mode Table  31.5 KHz, 60.0 Hz
;
[QV32_640x400_2]
Step01 = Table, Seq_Packed
Step02 = Table, QV_Setup_32
Step03 = 0B, 3C2h, 6Fh
Step04 = Table, QV_Dac_32
Step05a= 0B, 3D4h.00h, 5Fh, 4Fh, 50h, 81h, 53h \
Step05b=               9Fh, 0Bh, 3Eh, 00h, 40h \
Step05c=               00h, 00h, 00h, 00h, 00h \
Step05d=               00h, C2h, A4h, 8Fh, 40h \
```

20

```
Step05e=               00h, 95h, 03h, E3h, FFh
Step06 = 0B, 3CEh.42h, 01h
Step07 = 0B, 3CEh.51h, 08h
Step08 = Table, QV_Cursor
Step09 = Table, Attr_Ctrl_8
Step10 = Table, Graphics_Ctrl
;
;       QVISION  640x400x32 Mode Table  31.5 KHz, 70.0 Hz
;
[QV32_640x400_3]
Step01 = Table, Seq_Packed
Step02 = Table, QV_Setup_32
Step03 = 0B, 3C2h, 6Fh
Step04 = Table, QV_Dac_32
Step05a= 0B, 3D4h.00h, 5Fh, 4Fh, 50h, 82h, 54h \
Step05b=               80h, BFh, 1Fh, 00h, 40h \
Step05c=               00h, 00h, 00h, 00h, 00h \
Step05d=               00h, 9Ch, AEh, 8Fh, 00h \
Step05e=               00h, 96h, B9h, E3h, FFh
Step06 = 0B, 3CEh.42h, 02h
Step07 = 0B, 3CEh.51h, 28h
Step08 = Table, QV_Cursor
Step09 = Table, Attr_Ctrl_8
Step10 = Table, Graphics_Ctrl
;
;       QVISION  640x400x32 Mode Table  31.5 KHz, 60.0 Hz
;
[QV32_640x400_4]
Step01 = Table, Seq_Packed
Step02 = Table, QV_Setup_32
Step03 = 0B, 3C2h, 6Fh
Step04 = Table, QV_Dac_32
Step05a= 0B, 3D4h.00h, 5Fh, 4Fh, 50h, 81h, 53h \
Step05b=               9Fh, 0Bh, 3Eh, 00h, 40h \
Step05c=               00h, 00h, 00h, 00h, 00h \
Step05d=               00h, C2h, A4h, 8Fh, 00h \
Step05e=               00h, 95h, 03h, E3h, FFh
Step06 = 0B, 3CEh.42h, 02h
Step07 = 0B, 3CEh.51h, 08h
Step08 = Table, QV_Cursor
Step09 = Table, Attr_Ctrl_8
Step10 = Table, Graphics_Ctrl
;
;       QVISION  640x480x32 Mode Table  38.0 KHz, 72.0 Hz
;
[QV32_640x480_1]
Step01 = Table, Seq_Packed
Step02 = Table, QV_Setup_32
Step03 = 0B, 3C2h, FBh
Step04 = Table, QV_Dac_32
Step05a= 0B, 3D4h.00h, 65h, 4Fh, 50h, 07h, 54h \
Step05b=               99h, 06h, 36h, 00h, 60h \
Step05c=               00h, 00h, 00h, 00h, 00h \
Step05d=               00h, E8h, B8h, DFh, 00h \
Step05e=               00h, DFh, 06h, E3h, FFh
Step06 = 0B, 3CEh.42h, 02h
Step07 = 0B, 3CEh.51h, 08h
Step08 = Table, QV_Cursor
Step09 = Table, Attr_Ctrl_8
Step10 = Table, Graphics_Ctrl
```

```
;
;       QVISION  640x480x32 Mode Table  31.5 KHz, 60.0 Hz
;
[QV32_640x480_2]
Step01 = Table, Seq_Packed
Step02 = Table, QV_Setup_32
Step03 = OB, 3C2h, EFh
Step04 = Table, QV_Dac_32
Step05a= OB, 3D4h.00h, 5Fh, 4Fh, 50h, 81h, 53h \
Step05b=               9Fh, 0Bh, 3Eh, 00h, 40h \
Step05c=               00h, 00h, 00h, 00h, 00h \
Step05d=               00h, EAh, BCh, DFh, 00h \
Step05e=               00h, E5h, 03h, E3h, FFh
Step06 = OB, 3CEh.42h, 02h
Step07 = OB, 3CEh.51h, 08h
Step08 = Table, QV_Cursor
Step09 = Table, Attr_Ctrl_8
Step10 = Table, Graphics_Ctrl
;
;       Shutdown, program for planar, and restart the sequencer table
;
[Seq_Planar]
Step01 = OB, 3C4h.00h, 01h
Step02 = OB, 3C4h.01h, 01h, FFh, 00h, 06h
Step03 = OB, 3C4h.00h, 03h
;
;       Shutdown, program for packed, and restart the sequencer table
;
[Seq_Packed]
Step01 = OB, 3C4h.00h, 01h
Step02 = OB, 3C4h.01h, 01h, FFh, 00h, 0Eh
Step03 = OB, 3C4h.00h, 03h
;
;       Setup the Qvision controller for 4bpp mode
;
[QV_Setup_4]
Step01 = Table, Advanced_Setup
Step02 = OB, 63CAh, 01h
;
;       Setup the Qvision controller for 8bpp mode
;
[QV_Setup_8]
Step01 = Table, Advanced_Setup
Step02 = OB, 63CAh, 03h
;
;       Setup the Qvision controller for 16bpp mode
;
[QV_Setup_16]
Step01 = Table, Advanced_Setup
Step02 = OB, 63CAh, 05h
;
;       Setup the Qvision controller for 32bpp mode
;
[QV_Setup_32]
Step01 = Table, Advanced_Setup
Step02 = OB, 63CAh, 07h
;
;       Setup the Compaq controller for Advanced modes
;
[Advanced_Setup]
```

```
Step01 = OB, 3CEh.0Fh, 05h
Step02 = OB, 3CEh.40h, 41h
Step03 = OB, 3C4h.02h, FFh
Step04 = OB, 3CEh.10h, 28h
Step05 = Table, CRTC_Unlock
;
;       Unlock the CRTC registers
;
[CRTC_Unlock]
Step01 = IB, 3D4h.11h
Step02 = Logic, AND, 7Fh
Step03 = HB, 3D4h.11h
;
;       Setup the AVGA DAC for Advanced VGA modes (6-bit DAC mode)
;
[AV_DAC]
Step01 = OB, 83C6h, 00h
;
;       Setup the Qvision DAC for 4bpp mode
;
[QV_DAC_4]
Step01 = Table, QV_DAC_Setup
Step02 = OB, 13C8h, 60h
;
;       Setup the Qvision DAC for 8bpp mode
;
[QV_DAC_8]
Step01 = Table, QV_DAC_Setup
Step02 = OB, 13C8h, 40h
;
;       Setup the Qvision DAC for 15bpp mode
;
[QV_DAC_15]
Step01 = Table, QV_DAC_Setup
Step02 = OB, 13C8h, 20h
;
;       Setup the Qvision DAC for 16bpp mode
;
[QV_DAC_16]
Step01 = Table, QV_DAC_Setup
Step02 = OB, 13C8h, 28h
;
;       Setup the Qvision DAC for 32bpp mode
;
[QV_DAC_32]
Step01 = Table, QV_DAC_Setup
Step02 = OB, 13C8h, 00h
;
;       Setup the Qvision DAC for Qvision modes (8-bit, pixel port, int. clock)
;
[QV_DAC_Setup]
Step01 = OB, 83C6h, 02h
Step02 = OB, 13C9h, 20h
;
;       Setup the Qvision DAC for extended modes (Clock doubling)
;
[QV_DAC_Extended]
Step01 = IB, 83C6h
Step02 = LOGIC, OR, 80h
Step03 = HB, 83C6h
```

23

```
Step04 = OB, 03C8h, 01h
Step05 = IB, 13C6h
Step06 = LOGIC, OR, 08h
Step07 = HB, 13C6h
;
;       Setup the Qvision DAC for external clock
;
[QV_DAC_External]
Step01 = OB, 13C9h, 30h
;
;       Setup Qvision Extended 1024 pixel modes
;
[QV_Setup_1024]
Step01 = OB, 23C7h, 10h
Step02 = OB, 63CBh, 75h
;
;       Setup Qvision Extended 2048 pixel modes
;
[QV_Setup_2048]
Step01 = OB, 23C7h, 10h
Step02 = OB, 63CBh, 79h
;
;       Setup the Qvision Cursor
;
[QV_Cursor]
Step01 = OB, 83C8h, 00h
Step02a= OB, 83C9h, 00h, 00h, 00h \
Step02b=            00h, 00h, 00h \
Step02c=            FFh, FFh, FFh
;
;       Setup the Attribute Controller for 4bpp mode
;
[Attr_Ctrl_4]
Step01 = IB, 3DAh
Step02 = Table, Attr_Ctrl
Step03 = OB, 3C0h, 10h, 01h, 11h, 00h, 12h, 0Fh, 13h, 00h
;
;       Setup the Attribute Controller for 8bpp mode
;
[Attr_Ctrl_8]
Step01 = IB, 3DAh
Step02 = Table, Attr_Ctrl
Step03 = OB, 3C0h, 10h, 41h, 11h, 00h, 12h, 0Fh, 13h, 00h
;
;       Setup the Attribute Controller
;
[Attr_Ctrl]
Step01 = IB, 3DAh
Step02a= OB, 3C0h, 00h, 00h, 01h, 01h, 02h, 02h \
Step02b=           03h, 03h, 04h, 04h, 05h, 05h \
Step02c=           06h, 06h, 07h, 07h, 08h, 08h \
Step02d=           09h, 09h, 0Ah, 0Ah, 0Bh, 0Bh \
Step02e=           0Ch, 0Ch, 0Dh, 0Dh, 0Eh, 0Eh \
Step02f=           0Fh, 0Fh
;
;       Setup the Graphics Controller
;
[Graphics_Ctrl]
Step01a= OB, 3CEh.00h, 00h, 00h, 00h, 00h, 00h \
Step01b=               00h, 05h, 0Fh, FFh
```

24

APPENDIX C

Copyright 1993 Compaq Computer Corporation 1 2

```
[display]
;       Old style driver configuration information
dacmode=8
resource=small
resolution=high
print=false

[cpqliv04]
Controller=AVGA,Mode_800x600x4                  ; Define the controller and mode
Monitor=CPQ-Qvision_200, Mode1                  ; Define the monitor and mode
Resource=96x96                                  ; Set resource size to 96x96 DPI
Print=False                                     ; Setup to print configuration

[cpqlqv04]
Controller=QVision,Mode_1280x1024x4_1a          ; Define the controller and mode
Monitor=CPQ-Qvision_200, Mode1                  ; Define the monitor and mode
Resource=96x96                                  ; Set resource size to 96x96 DPI
Print=False                                     ; Setup to print configuration

[cpqlav08]
Controller=AVGA,Mode_640x480x8                  ; Define the controller and mode
Monitor=CPQ-Qvision_200, Mode1                  ; Define the monitor and mode
Resource=96x96                                  ; Set resource size to 96x96 DPI
Print=False                                     ; Setup to print configuration

[cpqlqv08]
Controller=QVision,Mode_1280x1024x8_1a          ; Define the controller and mode
Monitor=CPQ-Qvision_200, Mode1                  ; Define the monitor and mode
Resource=96x96                                  ; Set resource size to 96x96 DPI
Print=False                                     ; Setup no configuration print

[cpqhqv16]
Controller=Qvision, Mode_640x400x15_1           ; Define the controller and mode
Monitor=CPQ-Qvision_200, Mode1                  ; Define the monitor and mode
Resource=96x96                                  ; Set resource size to 96x96 DPI
Gamma=1.0                                       ; Setup display gamma to 1.0
Threshold=0.5                                   ; Setup B&W threshold to 50%
Print=False                                     ; Setup no configuration print

[cpqhqv32]
Controller=Qvision, Mode_640x400x32_1           ; Define the controller and mode
Monitor=CPQ-Qvision_200, Mode1                  ; Define the monitor and mode
Resource=96x96                                  ; Set resource size to 96x96 DPI
Gamma=1.0                                       ; Setup display gamma to 1.0
Threshold=0.5                                   ; Setup B&W threshold to 50%
Print=False                                     ; Setup no configuration print

[cpqauto]
IVBPP=4                                         ; Define IVGS bits/pixel
AVBPP=8                                         ; Define AVGA bits/pixel
QVBPP=8                                         ; Define Qvision bits/pixel
DriverLoaded=CPQLQV08.EXE
Print=False                                     ; Setup no configuration print

[config]
```

TOOLS D:\WINDOWS\COMPAQ.INI

I claim:

1. A method of operating a computer system to setup a video mode for a monitor and graphics controller installed in the system, said system also comprising memory, comprising the steps of:

determining the type of monitor installed in the system;

determining the type of graphics controller installed in the system;

reading a plurality of monitor type entries from a monitor file stored in memory so determine the video modes operable by said monitor;

reading a plurality of graphic controller type entries from a mode file stored in memory to determine the video modes operable by said graphics controller, wherein the mode file comprises video parameters corresponding to each video mode;

selecting a video mode by matching the video modes read from one of said plurality of monitor type entries with the video modes read from one of said plurality of graphic controller type entries; and programming the graphics controller with video parameters stored in said mode file corresponding to the video mode selected in said selecting step.

2. The method of claim 1, wherein said monitor file is in ASCII format.

3. The method of claim 1, wherein said mode file is in ASCII format.

4. The method of claim 1, further comprising:

prior to said selecting step, identifying a driver program from a plurality of driver programs stored in memory; and repeating said selecting step for each of said plurality of driver programs.

5. The method of claim 4, further comprising:

after said selecting step, writing the selected video mode for the driver program to a program file in memory.

6. The method of claim 5, wherein said program file comprises an executable program.

7. The method of claim 6, wherein said programming step comprises executing said program file.

8. The method of claim 1, wherein said memory comprises disk storage.

9. A computer system, comprising:

a display monitor;

a programmable graphics controller coupled to said display monitor;

a processor coupled to said programmable graphics controller via a bus; and memory, coupled to said bus;

wherein a monitor file and a mode file are stored in said memory, said monitor file for storing video modes operable by a plurality of types of display monitors, said mode file for storing video modes operable by a plurality of types of graphic controllers;

and wherein said processor is programmed to read said monitor file and said mode file to select a video mode operable by both said monitor and said graphics controller, and to program said graphics controller with video parameters stored in said mode file for the selected video mode.

10. The system of claim 9, wherein said memory comprises disk storage.

11. The system of claim 9, wherein said processor is also programmed to install a driver program for interfacing with said graphics controller.

12. The system of claim 11, wherein a plurality of driver programs are stored in said memory.

13. The system of claim 12, wherein said processor is also programmed to select a video mode operable by both said monitor and said graphics controller for each of said plurality of driver programs.

14. The system of claim 13, wherein said processor is also programmed to write a program file with video parameters corresponding to the selected video mode for each of said driver programs.

15. The system of claim 14, wherein said processor programs said graphics controller by executing the contents of said program file.

16. The system of claim 9, wherein said monitor file and said mode file are each in the ASCII format.

* * * * *